US005828302A

United States Patent [19]

Tsutsumi et al.

[11] Patent Number: 5,828,302

[45] Date of Patent: Oct. 27, 1998

[54] DOOR SENSOR WITH SELF-DIAGNOSING FUNCTION

[76] Inventors: Koji Tsutsumi, 4-10, Nishimaiko 7-chome; Ye Zengguang, 23-28-104, Shimizugaoka 1-chome, both of Tarumi-ku, Kobe; Shigeaki Sasaki, 1-20, Takaha-cho 5-chome, Nada-ku, Kobe, all of Japan

[21] Appl. No.: 847,364

[22] Filed: Apr. 24, 1997

[30] Foreign Application Priority Data

| | | | |
|---|---|---|---|
| Apr. 26, 1996 | [JP] | Japan | 8-130705 |
| Apr. 27, 1996 | [JP] | Japan | 8-130686 |
| Mar. 24, 1997 | [JP] | Japan | 9-090356 |

[51] Int. Cl.[6] ..... G08B 21/00

[52] U.S. Cl. ..... 340/540; 49/31; 340/556; 340/653; 340/661

[58] Field of Search ..... 340/540, 555, 340/556, 635, 653, 661; 49/25, 26, 28, 31

[56] References Cited

U.S. PATENT DOCUMENTS

| | | | |
|---|---|---|---|
| 3,742,222 | 6/1973 | Endl | 340/556 |
| 4,577,437 | 3/1986 | Gionet et al. | 49/25 |
| 5,015,840 | 5/1991 | Blau | 340/556 |
| 5,142,152 | 8/1992 | Boiucaner | 49/25 |
| 5,410,149 | 4/1995 | Winston, Jr. et al. | 340/556 |
| 5,424,532 | 6/1995 | Occheto et al. | 340/555 |
| 5,585,625 | 12/1996 | Spies | 340/556 |

FOREIGN PATENT DOCUMENTS

| | | |
|---|---|---|
| 0 501 858 A2 | 9/1992 | European Pat. Off. . |
| 7-38622 | 9/1995 | Japan . |

OTHER PUBLICATIONS

Patent Abstracts of Japan; vol. 095, No. 002, Mar. 31, 1995 & JP 06 311010 A (Nippon Signal Co Ltd: The), 4 Nov. 1994—abstract.

*Primary Examiner*—Glen Swann
*Attorney, Agent, or Firm*—William H. Murray, Esq.

[57] ABSTRACT

A door panel is actuated when an actuator sensor disposed near the door panel senses an object approaching the door panel. When a safety sensor mounted on the door panel senses an object while the door panel is opening, the door panel is stopped. When a safety sensor mounted on the door panel senses an object while the door panel is closing, the door panel is opened. Each of the sensors includes a light-emitting unit, a light-receiving unit and a control unit, and the sensor can detect for itself failure in any of the light-emitting unit, the light-receiving unit and the control unit.

29 Claims, 13 Drawing Sheets

DOOR SENSOR WITH SELF-DIAGNOSING FUNCTION

This application is based on Japanese Patent Application No. HEI 8-130705 filed on Apr. 26, 1996, Japanese Patent Application No. HEI 8-130686 filed on Apr. 27, 1996 with domestic priority claimed from the former one, and Japanese Patent Application No. HEI 9-90356 filed on Mar. 24, 1997 with domestic priority claimed from the former two applications, the contents of which are incorporated herein by reference.

This invention relates to an apparatus for diagnosing failure in a sensor for use with, for example, an automatic door system, and, in particular, to door sensors with self-diagnosing function.

BACKGROUND OF THE INVENTION

A sensor system for use with an automatic door system includes actuator sensors and safety sensors. Actuator sensors are sensors that, when detecting an object approaching an automatic door, e.g. a person who is going to pass through the doorway, actuate a door panel to open. Safety sensors include a closing path sensor and an opening path sensor. The closing path safety sensor is adapted to sense an object, if any, in the closing path of the door panel or in its vicinity during the travel of the door panel from its fully opened position to the fully closed position, and, whenever it senses an object, the closing path safety sensor causes the door panel to return to the fully opened position. The opening path safety sensor is adapted to sense an object, if any, in the opening path of the door panel or in the vicinity thereof during the travel of the door panel from its fully closed position toward the fully opened position. When the opening path safety sensor senses an object, it causes the door panel to stop moving or to move at a low speed.

If one or more of such sensors fail to operate properly, the door panel does not operate properly, which could cause damages to an object or human approaching the door.

Japanese Examined Utility Model Publication No. HEI 7-38622 published on Sep. 6, 1995 discloses a technique for sensing failure of an actuator sensor apparatus. According to the technique disclosed in this UM publication, the actuator sensor apparatus includes a plurality of object detectors, and outputs from the object detectors are compared with each other. If the difference between the detector outputs is larger than a predetermined value, it is judged that one or more of the object detectors are not operating properly. In this case, the door panel is kept open.

According to the technique disclosed in Japanese UM Publication No. HEI 7-38622, the door panel is opened if one of the object detectors does not operate properly. Therefore, this technique cannot be used for an opening path safety sensor. In addition, the sensor does not operate properly not only when the object detectors fail to properly operate but also when power supply to the sensor is interrupted.

Safety sensors may receive not only outputs from object detectors but also a door position representative signal from a detector which detects the position of the door panel. In such a case, if wiring for transmitting a door position representative signal to the safety sensor from the door position detector has a fault, the safety sensor cannot operate properly. According to the technique disclosed in Japanese UM Publication No. HEI 7-38622, only failure of the object detectors can be detected, and failure of other portions of the sensor cannot be detected.

An object of the present invention is to provide a door sensor with failure diagnosing function which can detect not only failure of object detectors but also failure in other portions of the sensor.

When some failure occurs in a sensor, it is desirable for a maintenance man to be able to determine in what portion of the sensor the failure has occurred. Another object of the present invention is to provide a door sensor with a failure diagnosing function by which a maintenance man can easily determine the portion where the failure has occurred.

In some applications, failure indicative information from a sensor may be applied to a door controller which controls the operation of a door system. A maintenance man can connect a hand-held computer (Handy Terminal) to the door controller to determine the failing portion by means of the hand-held computer. In some other cases, the failure indicative information may be transmitted from the door controller through a modem to a host computer which centrally controls a plurality of automatic door systems. In such a case, a failure indicative signal transmission line must be undesirably provided between the sensor and the door controller, in addition to a path for transmitting an object representative signal which indicates that a sensor has sensed an object in a path.

A still further object of the present invention is to provide a door sensor in which failure indicative information is transmitted, being superposed on an object representative signal.

SUMMARY OF THE INVENTION

According to a first feature of the present invention, an actuator sensor is provided, which senses an object approaching a door panel of an automatic door system and makes the door panel be actuated. The actuator sensor includes a light-emitting unit which emits light into a space or onto a floor near the door panel. Light emitted by the light-emitting unit and reflected from an object or from the floor is received by a light-receiving unit. A control unit determines whether an object is present or not on the basis of the amount of light received by the light-receiving unit. When the presence of an object is determined, the control unit supplies a door controller enabling signal for opening the door panel, to a door controller which controls the opening and closing operation of the door panel. The control unit includes a plurality of failure detecting means for detecting failure of portions of the light-emitting unit, the light-receiving unit and the control unit. When any of failure detecting means determines failure of any of the light-emitting unit, the light-receiving unit and the control unit, that failure detecting means continuously develops a door controller enabling signal for opening the door panel.

According to the first feature, a door controller enabling signal for opening the door panel is developed when an object approaching the door panel is sensed. In response to the door controller enabling signal, the door controller opens the door panel. If one of the light-emitting unit, the light-receiving unit and the control unit which are important to the operation of the actuator sensor fails, the failure detecting means for that portion continuously develops a door controller enabling signal for opening the door panel, which causes the door controller to operate to keep the door panel open. Accordingly, it never occurs that the door panel may be kept closed so that an object, e.g. a human, may collide with the closed door. Thus, the object is secured safe.

According to a second feature of the present invention, a safety sensor is provided. The safety sensor senses an object when it is present in a door panel closing path along which the door panel moves from its fully opened position to the fully closed position. The safety sensor according to the second feature includes a light-emitting unit which emits light to or near the door panel closing path. A light-receiving unit receives light emitted from the light-emitting unit and reflected by an object or the floor in or near the door panel closing path. A control unit determines whether an object is present or not on the basis of the amount of light received by the light-receiving unit. When the presence of an object is determined, the control unit supplies a door controller enabling signal for opening the door panel, to a door controller which controls the opening and closing operation of the door panel. The control unit includes a plurality of failure detecting means which detect failure of the light-emitting unit, the light-receiving unit and the control unit. When any of failure detecting means determines failure of the light-emitting unit, the light-receiving unit or the control unit, that failure detecting means continuously develops a door controller enabling signal for opening the door panel.

According to the second feature of the invention, the safety sensor develops a door controller enabling signal for opening the door panel whenever it senses an object standing in or near the closing path of the door panel. In response to the door controller enabling signal, the door controller opens the door panel full. If any one of the light-emitting unit, the light-receiving unit and the control unit which are important to the operation of the safety sensor fails, the failure detecting means which has detected the failure continuously develops a door controller enabling signal for opening the door panel, which causes the door controller to operate to keep the door panel open. Accordingly, it never occurs that an object standing in or near the door panel closing path is caught and held between the door panel and a doorjamb or collides with the door panel. Thus, the object is secured safe.

According to a third feature of the present invention, a safety sensor is provided, which senses an object when it is present in a door panel opening path along which the door panel moves from its fully closed position to the fully opened position. The sensor includes a light-emitting unit which emits light to or near the door panel opening path. A light-receiving unit receives light emitted from the light-emitting unit and reflected by an object or the floor in or near the door panel opening path. A control unit determines whether an object is present or not on the basis of the amount of light received by the light-receiving unit. When the presence of an object is determined, the control unit supplies a door controller enabling signal for stopping the door or moving it at a low speed, to a door controller which controls the opening and closing operation of the door panel. The control unit includes a plurality of failure detecting means which detect failure of the light-emitting unit, the light-receiving unit and the control unit. When any of failure detecting means determines failure of the light-emitting unit, the light-receiving unit or the control unit, that failure detecting means continuously develops a door controller enabling signal for stopping the door panel or moving it at a low speed.

The safety sensor according to the third feature of the invention develops a door controller enabling signal for stopping the door panel or opening it at a low speed whenever an object is present in or near the door panel opening path. In response to the door controller enabling signal, the door controller stops the door panel or moving it at a low speed. If one of the light-emitting unit, the light-receiving unit and the control unit which are important to the operation of the safety sensor fails, the failure detecting means for detecting the failure continuously develops a door controller enabling signal for stopping the door panel or moving it at a low speed, which causes the door controller to operate to keep the door panel stopping or moving at a reduced speed. Accordingly, it never occurs that an object standing in or near the door panel opening path may be caught between the door panel and a doorjamb or wall or collide with the door panel. Thus, the object is secured safe.

The control unit of the sensor according to the first, second or third feature of the present invention may include a control section. One of a plurality of failure detecting means is a light-emitting unit failure detecting program, stored in the control section, which determines that the light-emitting unit includes a failure when the voltage for driving the light-emitting unit is outside a predetermined allowable range. A CPU (a microprocessor) may be used as the control section of the control unit.

When the light-emitting unit is operating properly, the value of the voltage for driving the light-emitting unit should be within a predetermined allowable range. However, if the light-emitting unit fails, the value of the light-emitting unit driving voltage will be outside the allowable range. If the value of the voltage applied to the light-emitting unit is outside the allowable range, it is determined that the light-emitting unit is not operating properly. Accordingly, it is possible to avoid any accidents to passengers which could be caused by the failure of the light-emitting unit, by repairing or replacing the light-emitting unit.

The light-emitting unit of the actuator sensor according to the first feature may include a plurality of light-emitters, and a control unit may include a control section. One of the failure detecting means is a light-emitting unit failure detecting program, stored in the control section, which determines that the light-emitting unit fails, when the voltages for driving a predetermined number of said plurality of light-emitters are outside an allowable range.

In an actuator sensor like the one according to the first feature, if the number of failing light-emitters is less than a predetermined number, the remaining light-emitters in cooperation with the light-receiving unit can detect the presence of an object approaching the door system and cause the door panel to be opened. Then, if the door panel is kept fully open even when a small number of light-emitters, e.g. one light-emitter, fails, the building security may be endangered. According to the invention, the door panel may be kept open only when more than a predetermined number of light-emitters fail.

The light-receiving unit of the door sensor according to the first, second or third feature of the invention may include a light-receiver and a received-light amplifier for amplifying a signal from the light-receiver which represents the amount of received light. The control unit may include a control section. One of the failure detecting means is a received-light amplifier failure detecting program stored in the control section, which program determines that the received-light amplifier fails when the value of the output voltage of the received-light amplifier is outside an allowable range.

A signal representative of the amount of received light supplied from the light-receiver is amplified by the received-light amplifier. If the received-light amplifier fails, the output voltage of the amplifier will be outside the allowable range, from which failure of the received-light amplifier can be detected. Thus, accidents to an object approaching the door panel, such as collision with the door panel, can be avoided.

The light-receiving unit may include a plurality of light-receivers and a received-light amplifier which amplifies successive ones of signals from the light-receivers which represent the amounts of light received by the respective light-receivers. The control unit may include a control section. One of the failure detecting means is a received-light amplifier failure detecting program stored in the control section, which program determines that the received-light amplifier fails, when the values of the output voltages of the received-light amplifier corresponding respectively to the amounts of light received by the light-receivers are outside an allowable range.

In some case, the amplifier voltage corresponding to the amount of light received by a light-receiver may be disturbed by noise and, therefore, be outside its allowable range. Therefore, it is not clever to determine that the received-light amplifier fails only because the amplifier voltage corresponding to the amount of light received by one light-receiver is outside the allowable range. Accordingly, it is determined that the received-light amplifier fails only when the amplifier output voltages corresponding to the amounts of light received by all of the light-receivers are outside the allowable range. This arrangement can prevent undesired opening, stopping or moving at a reduced speed of the door panel.

The sensor may be arranged such that during the travel of the door panel, a door position representative signal indicative of a current position of the door panel developed by an encoder associated with a door engine is applied through an encoder signal line to the control unit. The control unit includes a control section and an encoder input section which receives the door position representative signal from the encoder. One of the failure detecting means is an encoder failure detecting program stored in the control section, which judges that the encoder input section or the encoder signal line fails if the door position representative signal is not applied to the control unit within a predetermined time period after the actuation of the door panel.

When the door panel moves, which means that the door engine and, hence, the encoder start operating, the door position representative signal should be generated and supplied by the encoder to the control unit within a predetermined time. If no door position representative signal is applied to the control unit even when the predetermined time has passed after the actuation of the door panel, it can be determined that the encoder signal line or the encoder input section fails.

The sensor may be arranged such that during the travel of the door panel, a door position representative signal indicative of a current position of the door panel developed by an encoder associated with a door engine is applied through an encoder signal line to the control unit, and the control unit includes a control section and an encoder input section which receives the door position representative signal from the encoder. One of the failure detecting means is an encoder failure detecting program stored in the control section, which judges that the encoder input section or the encoder signal line fails when the door position representative signal which should be generated at a reference door position the door panel assumes after one cycle of door movement does not coincide with the door position representative signal which the encoder actually provides. (One cycle of door movement is intended for the door movement from the reference position to the fully opened (closed) position and then through the reference position to the opposite fully closed (opened) position and returns to the reference position. If the reference door position is the fully closed position, for example, one cycle of the door movement is the movement from the fully closed position to the fully opened position and back to the fully closed position.)

The door panel may travel from the fully closed position to the fully opened position and then return to the fully closed position. In this case, the position representative signal generated when the door panel returns should be equal to the position representative signal generated when the door panel was at the original fully closed position. However, if the encoder input section or encoder signal path fails, the two door position representative signals do not coincide, from which the failure detecting means can determine the failure. This improves the object's safety.

One of the failure detecting means may be a monitor section for detecting a fault in the control section or in power supply to the control section. The monitor section detects when a periodic development of a watchdog signal in the control section is interrupted, which is judged to indicate failure in the control section. In addition, it judges the power supply to the control section to have a fault when it determines that the supply voltage to the control section becomes lower than a predetermined voltage.

The monitor section can detect failure in the control section, which is the most important part of the control unit of the sensor, and also failure in the power supply to the control section.

One of the failure detecting means of the sensor may be a relay circuit which is activated when power to the sensor is interrupted, and which has a contact for continuously providing a door controller enabling signal when it is closed.

With this arrangement, a door controller enabling signal is continuously supplied from the sensor when power supply to the sensor is interrupted, and, therefore, an object is prevented from colliding with the door panel or being caught between the door panel and the doorjamb. Thus, the object's safety is secured.

According to a fourth feature of the present invention, a sensor includes a light-emitting unit which emits light into a space or onto a floor near a door panel, a light-receiving unit which receives light as emitted from the light-emitting unit and reflected by an object or the floor, and a control unit which determines the presence or absence of an object approaching the door panel on the basis of the amount of light received by the light-receiving unit. The control unit is adapted to supply a door controller enabling signal to a door controller for controlling the operation of the door panel when an object approaching the door panel is sensed. The control unit includes a plurality of failure detecting means for detecting failure of the light-emitting unit, light-receiving unit and control unit, and when failure detecting means detects failure, the control unit continuously develops a door controller enabling signal including information about the detected failure.

According to the fourth feature of the invention, when the light-emitting-unit, the light-receiving unit or the control unit fails, information about the failure is carried on a door controller enabling signal which the control unit supplies to the door controller. A maintenance man can derive the information about the failure from the door controller and know about the failure of the sensor, which enables him to get necessary replacement parts or to get knowledge as to how to repair the door system before actually starting repairs. Accordingly, the repairs can be done in a short time and in an efficient manner. In addition, since the information about the failure is included in the door controller enabling signal, no dedicated line for transmitting the failure-relating information need be added.

The control unit of the sensor according to the fourth feature may include a signal output section for providing a door controller enabling signal to the door controller. When one of the failure detecting means detects failure of the light-emitting unit, the light-receiving unit or the control unit, a pulsating door controller enabling signal indicating the failing portion is continuously provided from the signal output section. Whenever the light-emitting unit, the light-receiving unit or the control unit fails, a pulsating door controller enabling signal is applied to the door controller, and, therefore, a maintenance man can identify the failing portion without disassembling the sensor and also can get replacement parts or consider how to repair the sensor before he starts repairing. Accordingly, the repairs can be done in a short time and in an efficient manner. Further, no dedicated line for transmitting failure-relating information is required since it is carried on the pulsating door controller enabling signal.

The control unit of the sensor according to the fourth feature may include a signal output section for providing a pulsating door controller enabling signal, and, when one of the failure detecting means detects failure of the light-emitting unit, the light-receiving unit or the control unit, the signal output section continuously provides a pulsating door controller enabling signal indicating whether the sensor should be replaced or repaired. Accordingly, even an inexperienced maintenance man can readily take necessary actions against the failure.

According to a fifth feature of the present invention, a sensor includes a light-emitting unit for emitting light into the space or onto the floor near a door panel, a light-receiving unit for receiving light as emitted by the light-emitting unit and reflected from an object or the floor, and a control unit. The control unit determines the presence of an object approaching the door panel on the basis of the amount of light received by the light-receiving unit, and, when the presence of an object is determined, provides a door controller enabling signal to a door controller which controls the opening and closing operation of the door panel. The sensor further includes an indicator unit indicating the operation state of the sensor. The control unit further includes a plurality of failure detecting means which detect failure of the control unit, the light-emitting unit and the light-receiving unit. When one of the failure detecting means detects failure, the control unit develops continuously a door controller enabling signal and also makes the indicator unit indicate information about the failure.

According to the fifth feature, because information relating to failure is indicated on the indicator unit of the sensor, a maintenance man can derive information relating to the failure from the indicator unit even if the door controller used with the door system does not have a function to read the information relating to the failure from the door controller enabling signal.

The control unit may be arranged to make the indicator unit indicate the failing portion, so that a maintenance man can determine the failing portion from indication on the indicator unit even if the door controller used for the door system does not have a function to derive the information relating to the failure from the door controller enabling signal.

The control unit may be arranged to make the indicator unit indicate which action should be taken, replacement of the sensor or inspection of the sensor. Accordingly, if the door controller is of a type that cannot derive information relating to failure from the door controller enabling signal, a maintenance man can know from the indication on the indicator which action should be taken, replacement of the sensor or inspection of the sensor.

DESCRIPTION OF PREFERRED EMBODIMENTS

Swing Door System

Figure 1:
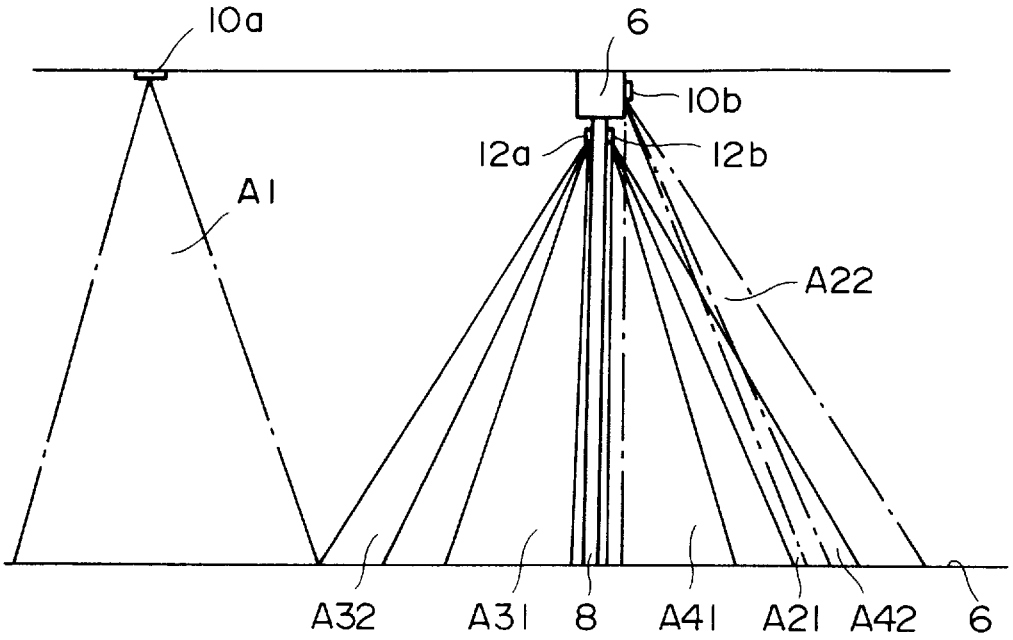
FIG. 1 is a side view of a swing door system employing sensors according to the present invention.
Figure 2A:
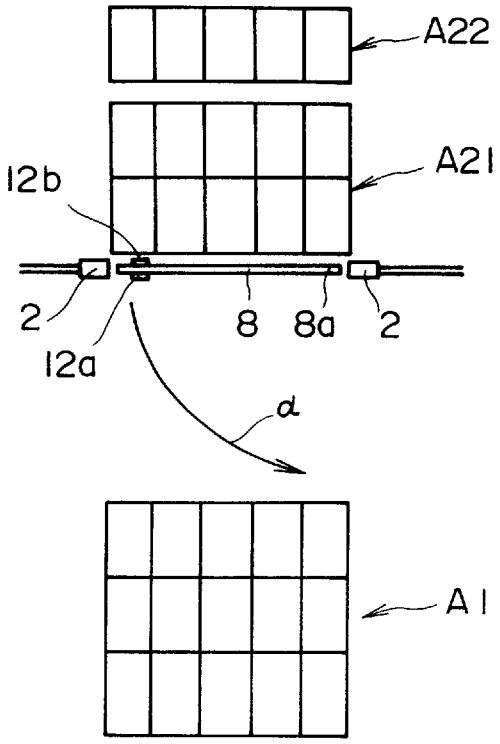
FIG. 2(*a*) shows sensing areas of actuator sensors of the swing door system of FIG. 1, and FIG. 2(*b*) shows sensing areas of safety sensors of the swing door system of FIG. 1.
Figure 2B:
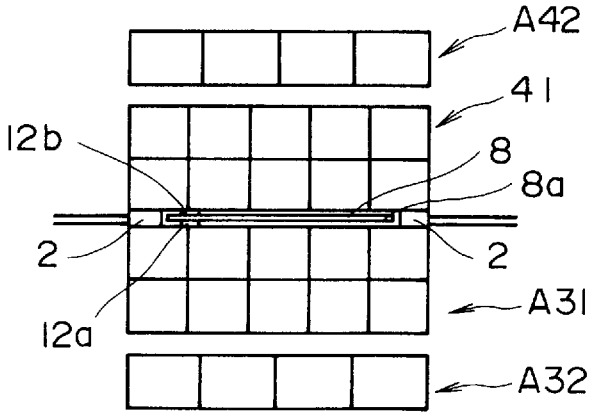
Figure 3A:
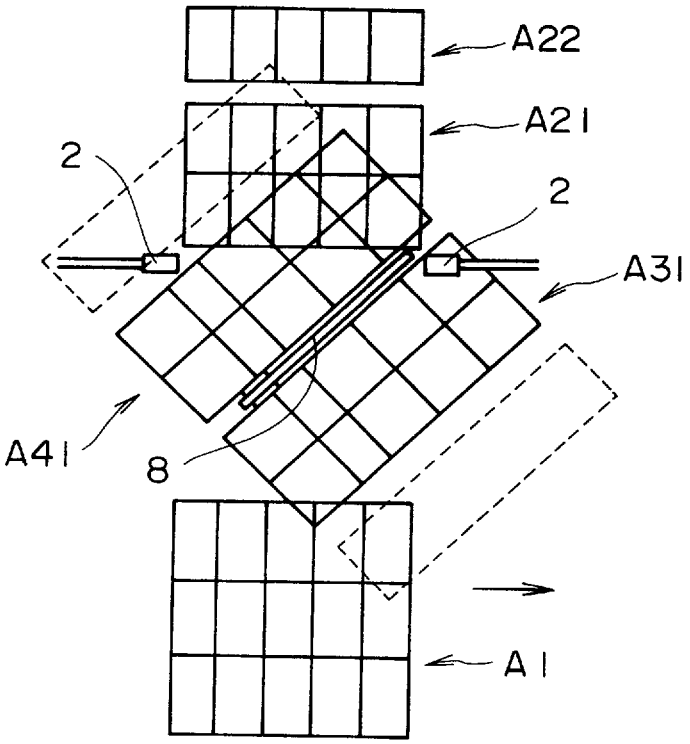
FIG. 3(*a*) shows a door panel of the swing door system of FIG. 1 when it is moving from its fully closed position to the fully opened position, and FIG. 3(*b*) shows the door panel in its fully opened position.
Figure 3B:
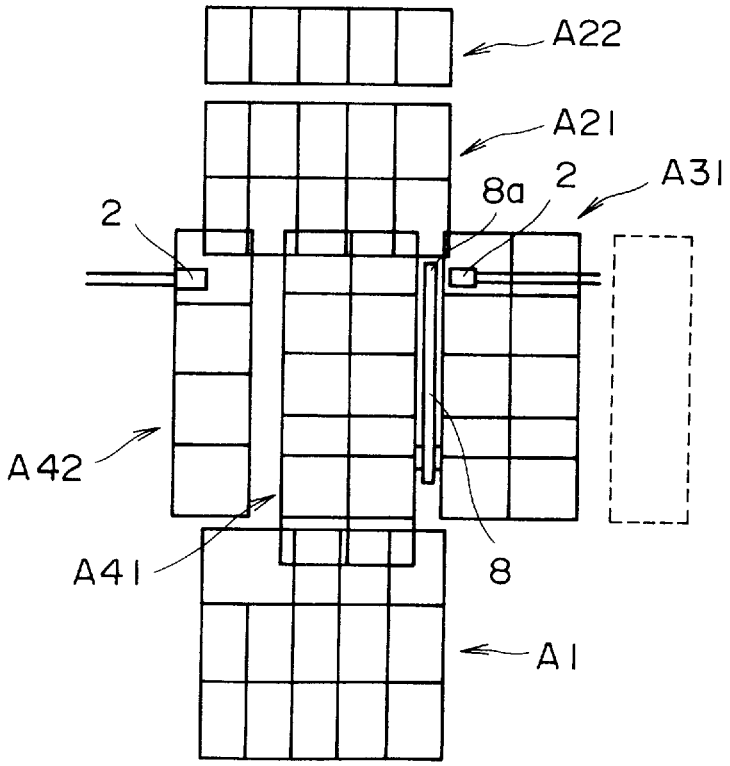

FIGS. 1 through 3 shows the present invention which is embodied in sensors for a swing door system. The swing door system includes a door panel 8 mounted to close a doorway defined by doorposts 2 (FIGS. 2(*a*) and 2(*b*)), a lintel 4 and a floor 6 shown in FIG. 1. The door panel 8 can rotate about an axis 8*a* disposed nearer to one doorpost 2 as shown in FIG. 2.

Sensors

An actuator sensor 10*a* is mounted on a ceiling on one side of the lintel 4. On the surface of the lintel 4 on the other side, an actuator sensor 10*b* is mounted. When one of the actuator sensors 10*a* and 10*b* senses an object, e.g. a human, approaching the door panel 8, the panel 8 is driven to rotate as indicated by an arrow $\alpha$ in FIG. 2(*a*) so that the human can pass through the doorway. After the human passes through the doorway, the door panel 8 rotates in the opposition direction to close the doorway.

On the surfaces on both sides of the door panel 8 at its upper section, an opening path safety sensor 12*a* and a closing path safety sensor 12*b* are mounted. When the opening path safety sensor 12*a* senses an object while the door panel 8 is opening, the door panel 8 is stopped or moved at a reduced speed to avoid the collision of the door panel with the sensed object.

If the closing path safety sensor 12*b* senses an object during the closing operation of the door panel 8, the panel 8 is re-opened from the position where the object is sensed, in order to avoid the collision of the door panel 8 with the object.

The sensors 10*a*, 10*b*, 12*a* and 12*b* form sensing areas for sensing objects. As shown in FIGS. 1 and 2(*a*), the actuator sensor 10*a* forms a sensing area A1 at a location remote from the door panel. The sensing area A1 includes 5×3 sub-sensing areas.

As shown in FIGS. 1 and 2(*a*), the actuator sensor 10*b* forms a main sensing area A21 and an auxiliary sensing area A22, on the other side of the door panel 8. The main sensing area A21 is closer to the door panel and the auxiliary sensing area A22 is slightly spaced from the main sensing area A21 in the direction away from the door panel 8. The main sensing area A21 includes 5×2 sub-areas, and the auxiliary sensing area A22 includes 5×1 sub-areas.

As shown in FIGS. 1 and 2(*b*), the safety sensor 12*a* forms a main sensing area A31 and an auxiliary sensing area A32 on the one side of the door panel 8. The main sensing area A31 is nearer to the door panel 8, and the auxiliary sensing area A32 is slightly spaced from the main sensing area A31 in the direction away from the door panel 8. The main sensing area A31 includes 5×2 sub-areas, and the auxiliary sensing area A32 includes 4×1 sub-areas.

The safety sensor 12*b* forms a main sensing area A41 and an auxiliary sensing area A42 on the other side of the door panel 8. The main sensing area A41 is nearer to the door panel 8, and the auxiliary sensing area A42 is slightly spaced from the main sensing area A41 in the direction away from the door panel 8. The main sensing area A31 includes 5×2 sub-areas, and the auxiliary sensing area A32 includes 4×1 sub-areas.

Because the safety sensors 12*a* and 12*b* are mounted on the door panel 8, the sensing areas A31 and A41 move as the door panel 8 rotates, as shown in FIG. 3(*a*). The auxiliary sensing areas A32 and A42 are arranged to disappear when the door panel 8 starts rotating, so that the auxiliary sensing areas A32 and A42 are prevented from sensing objects which less likely collide with the door panel 8 and, hence, unnecessary stopping of the door panel, lowering of the moving speed, or reversal of the moving direction of the door is avoided. The auxiliary sensing area A42 is restored when the door panel 8 reaches the fully opened position so that a human standing near the doorpost opposite the rotation axis 8*a* can be sensed.

Figure 4:
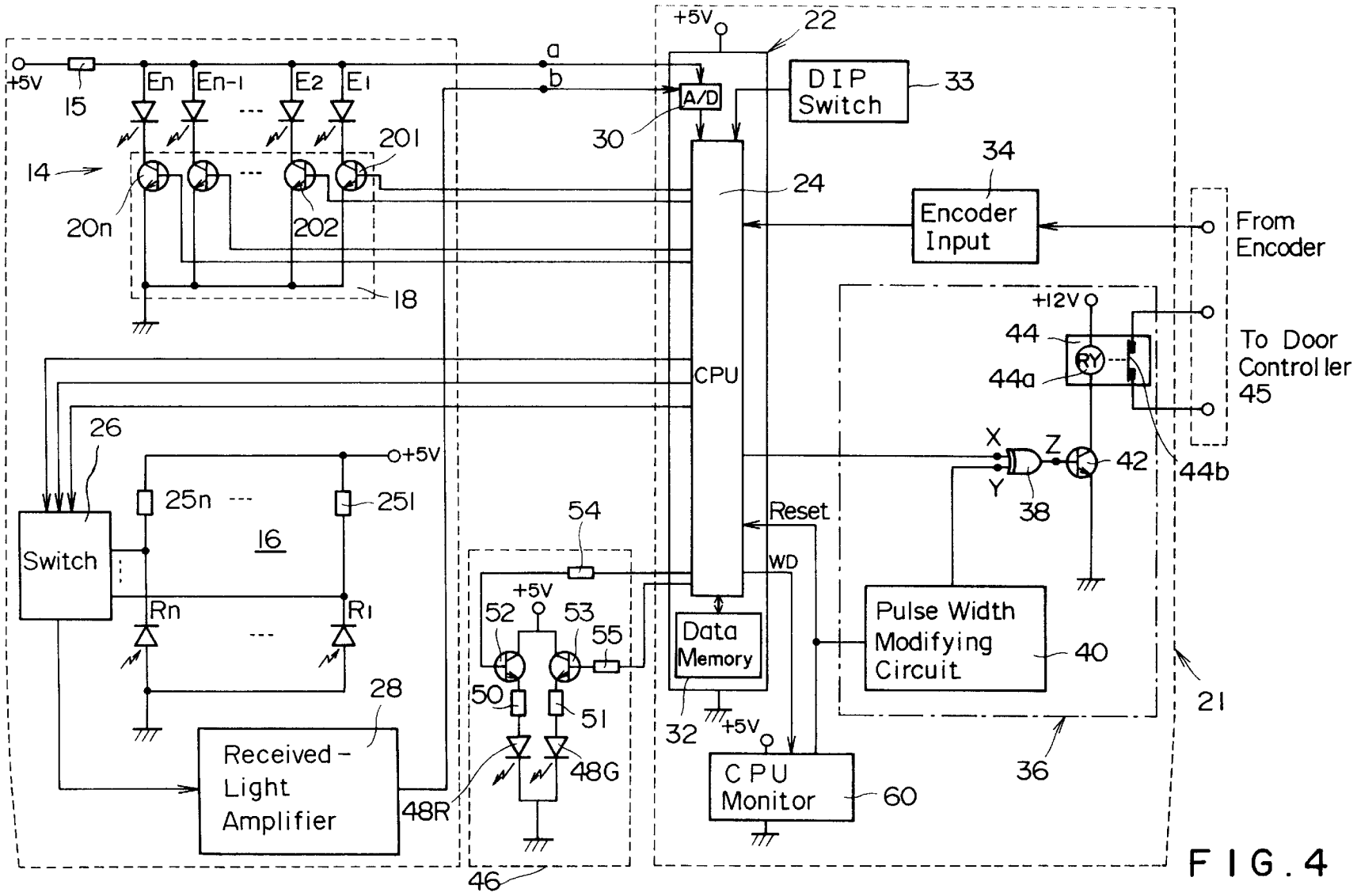
FIG. 4 is a block circuit diagram of the sensors.

In order to form the sensing areas, each of the sensors 10*a*, 10*b*, 12*a* and 12*b* is arranged as shown in FIG. 4.

Each sensor includes a light-emitting unit 14 and a light-receiving unit 16. The light-emitting unit 14 includes a plurality, n, of light-emitter, e.g. infrared light-emitting diodes E1–En. The plurality, n, is the number of sub-areas constituting the sensing areas formed by a particular sensor. The light-receiving unit 16 includes the same number, n, of light-receivers, e.g. infrared light-receiving diodes R1–Rn, which form pairs with corresponding ones of the light-emitters E1–En. One pair forms, for example, one sub-area.

The light-emitting diodes E1–En have their anodes connected together through a resistor 15 to a +5 V DC voltage source, and have their cathodes grounded through respective switching transistors 201–20n of a driving unit 18. The bases of the switching transistors 201–20n are connected to a CPU (microprocessor) 24 in a control section 22 in a control unit 21. When a control signal is selectively applied to the switching transistors 201–20n from the CPU 24, the transistor receiving the control signal is rendered conductive and the light-emitting diode connected thereto emits light.

The cathodes of the light-receiving diodes R1–Rn are connected through respective resistors 251–25n to a +5 V DC voltage source, and have their anodes grounded. The light-receiving diodes R1–Rn receive the light as emitted from the corresponding ones of the light-emitting diodes and reflected from the floor or an object in a sensing area, and develop respective received-light representative signals proportional to the magnitudes of the received light. The received-light representative signals are derived from the cathodes of the light-receiving diodes and are applied to a light-receiver switching circuit 26. The light-receiver switching circuit 26 also receives a succession of selection command signals from the CPU 24. Each selection command signal specifies which light-receiver is to be selected. The received-light representative signals from the successively selected light-receivers are applied from the switching circuit 26 to a received-light amplifier 28, which amplifies successively applied received-light representative signals. The amplified received-light representative signals are converted to digital received-light representative signals in an analog-to-digital (A/D) converter 30 in the control section 22. The digital received-light representative signals are applied to the CPU 24.

The control section 22 includes a data memory 32 in which reference values for the respective sub-areas of the respective sensing areas have been stored. The CPU 24 compares the digital received-light representative signal applied thereto with the reference value stored in the data memory 32 for the sub-area corresponding to the received digital received-light representative signal in order to determine if an object is present in that sub-area.

It should be noted that since the safety sensors 12*a* and 12*b* rotate with the door panel 8, the reference values for the sub-areas change for respective angular positions (i.e. door positions) of the door panel. The data memory 32, therefore, has reference values stored therein for the respective sub-areas in the respective door positions. In order to read the reference values for respective door positions from the data memory 32, the CPU 24 receives a signal from an encoder (not shown) at an encoder input section 34, each time the door panel 8 moves through a predetermined angle. The encoder is associated with an engine (see FIG. 11) which drives the door panel 8.

The sensing areas of the actuator sensors 10*a* and 10*b* do not move even when the door panel 8 moves. Accordingly, the encoder need not supply any signal to the CPU 24 for the actuator sensors 10*a* and 10*b*, and the data memory 32 stores only one reference value for each of the sub-areas of the sensing areas of the sensors 10*a* and 10*b*.

When it determines the presence of an object on the basis of the comparison of the digital received-light representative signal with the corresponding reference value, the CPU 24 develops a door controller enabling signal at, for example, a high (H) level, which is applied to one input terminal X of an exclusive OR gate 38 in a signal output section 36 of the control unit 21. On the other hand, when the CPU determines the absence of an object, it develops a signal at, for example, a low (L) level, which is applied to the input terminal X of the exclusive OR gate 38. The other input terminal Y of the exclusive OR gate 38 receives a signal from a pulse-width modifying circuit 40. As will be described later, the signal supplied by the pulse-width modifying circuit 40 is at a high (H) level when the CPU 24 functions well. Accordingly, when no object is detected, an H-level output is developed at an output terminal Z of the exclusive OR gate 38, whereas a L-level output is developed at the output terminal Z when an object is detected.

The output terminal Z of the exclusive OR gate 38 is connected to the base of a switching transistor 42. The transistor 42 has its collector-emitter conduction path connected in series with a relay coil 44*a* of a relay 44. The end of the relay coil 44 opposite to the end connected to the collector of the switching transistor 42 is connected to a +12 V DC voltage source, and the emitter of transistor 42 is grounded. Thus, when the base of the switching transistor 42 receives an H-level output from the exclusive OR gate 38, the transistor 42 is rendered conductive and, therefore, DC current flows through the relay coil 44*a*. The relay 44 is arranged such that when no current is flowing through the relay coil 44*a*, a normally closed contact 44*b* is kept closed, and when current flows through the relay coil 44*a*, the contact 44*b* is opened. Thus, when the absence of an object is detected, the contact 44*b* is opened, and when the presence of an object is detected, the contact 44*b* is closed.

Figure 11:
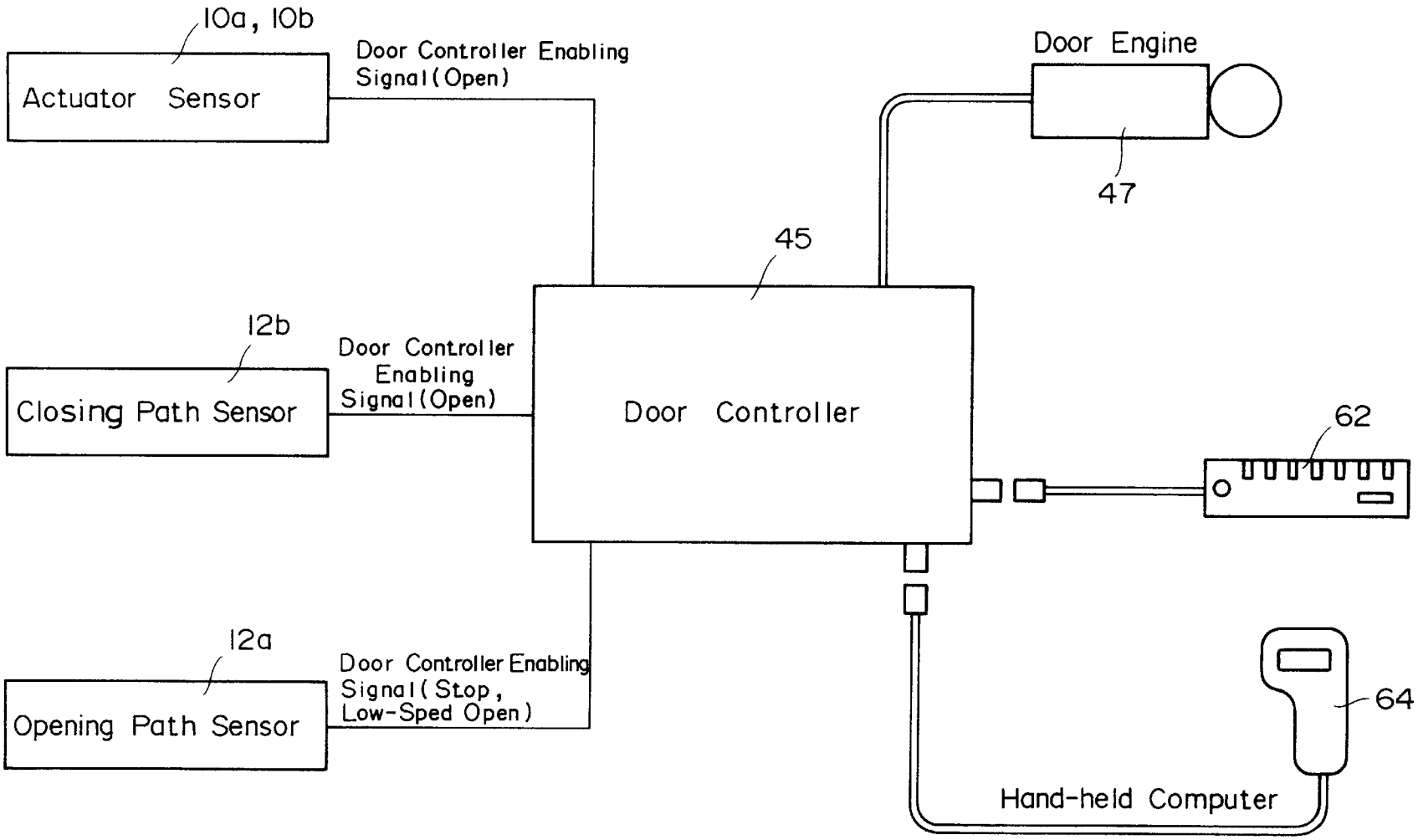
FIG. 11 is a schematic block diagram of the swing door system shown in FIG. 1.

The contact 44*b* is connected to a door controller 45 (FIG. 11). When the contact 44*b* is closed, a door control signal is generated in the door controller 45. For the actuator sensor 10*a* or 10*b*, when the contact 44*b* is closed, the door controller 45 controls a door engine 47 to open the door panel 8 toward the fully opened position. For the safety sensor 12*a*, the door controller 45 controls the door engine 47 to cause the door panel 8 to stop or move at a lower speed. For the safety sensor 12*b*, the door controller 45 controls the door engine 47 to cause the door panel to open toward the fully opened position.

Self-Diagnosing

If failure occurs in the light-emitting unit 14, the light-receiving unit 16 or the CPU 24 of either of the actuator sensors, the CPU 24 of that sensor continuously provides a door controller enabling signal containing failure information to the door controller 45. For the safety sensors, in addition to the above-described failure, failure of the encoder input section 34 and a fault in an encoder line connecting the encoder to the encoder input section 34 cause the CPU 24 to supply a door controller enabling signal containing failure information to the door controller 45. The failure information is arranged such that the door controller 45 can read from the information, the necessity of replacement of that sensor or the necessity of inspection of the sensor. When the power to the sensor is interrupted, the CPU 24 supplies a door controller enabling signal containing failure information telling this fact to the door controller 45.

The sensor indicates the judgment made by the CPU 24 as to whether the sensor should be replaced or inspected, on an indicator section, e.g. an indicator 46 shown in FIG. 4. The indicator 46 includes two indication devices emitting different colors of light, e.g. red and green. The indication devices may be, for example, light-emitting diodes 48R and 48G. The diodes 48R and 48G have their cathodes grounded. The anode of the diode 48R is connected to a +5 V DC voltage source via a series combination of a bias resistor 50 and the emitter-collector conduction path of a switching transistor 52 with the collector connected to the +5 V DC voltage source. The anode of the diode 48G is connected to the +5 V DC voltage source via a series combination of a bias resistor 51 and the emitter-collector conduction path of a switching transistor 53 with the collector connected to the +5 V DC voltage source. The bases of the switching transistors 52 and 53 are connected to the CPU 24 via respective resistors 54 and 55.

Sequence of Self-Diagnosing

Figure 5:
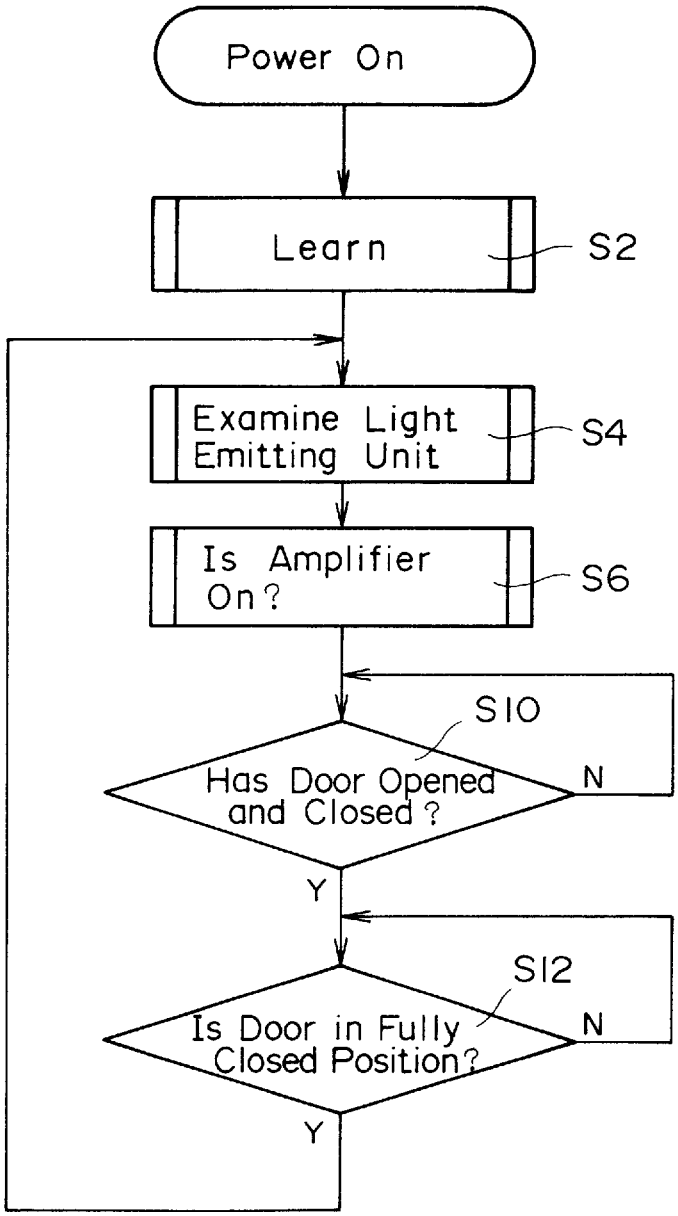
FIG. 5 is a flow chart of the operation of the sensors.

As shown in FIG. 5, when power is supplied to the sensor 10*a*, 10*b*, 12*a* or 12*b*, the CPU 24 enters into learning operation (Step S2). In this learning step, upon the application of power, the door panel 8 is moved from the fully closed position to the fully opened position and, from there back to the fully closed position. During this initial movement of the door panel, the CPU 24 computes respective door positions, using a signal from the encoder associated with the door engine, in order to use the computed door positions in controlling the opening and closing operation of the door panel 8. The computed door positions are stored in the data memory 32. For the safety sensor 12*a*, 12*b*, in addition to the door positions, reference values for the respective sub-areas of the sensing area in the respective door positions are determined and stored in the data memory 32. While the learning is being done, the CPU 24 examines the encoder input section 34 as to whether it operates properly, and also examines the encoder line as to whether it is broken.

Next, the CPU 24 examines the light-emitting unit (Step S4) as to if the light-emitters E1–En are opened or short-circuited. After that, the CPU 24 examines the received-light amplifier 28 (Step S6) as to if the amplifier 28 is opened or short-circuited.

Then, the CPU 24 judges whether the door panel 8 has opened and then closed (Step 10). If the door panel 8 has not opened and closed, the Step S10 is repeated. When the CPU 24 judges that the door panel 8 has opened and closed, it examines whether the door panel 8 is in the fully closed position (Step S12). If the door panel 8 is not in the fully closed position, the processing of Step S12 is repeated until the CPU 24 judges that the door panel 8 is in the fully closed position. After that, the processings of Steps S4 through S12 are repeated.

As described above, the examination of the encoder is made only when power is first supplied to the sensor, but the examinations of the light-emitting unit and the received-light amplifier are made repetitively. Although not shown in FIG. 5, while these examinations are being made, the respective light-emitters emit light, the respective light-receivers receive reflected light, and the CPU 24 receives received-light representative signals and determines the presence or absence of an object on the basis of the received-light representative signals.

Interruption of the power to the sensor can be immediately detected. If the CPU 24 operates abnormally, it can be also detected immediately.

Detection of Failure of Encoder Input Section or Encoder Line

Figure 6A:
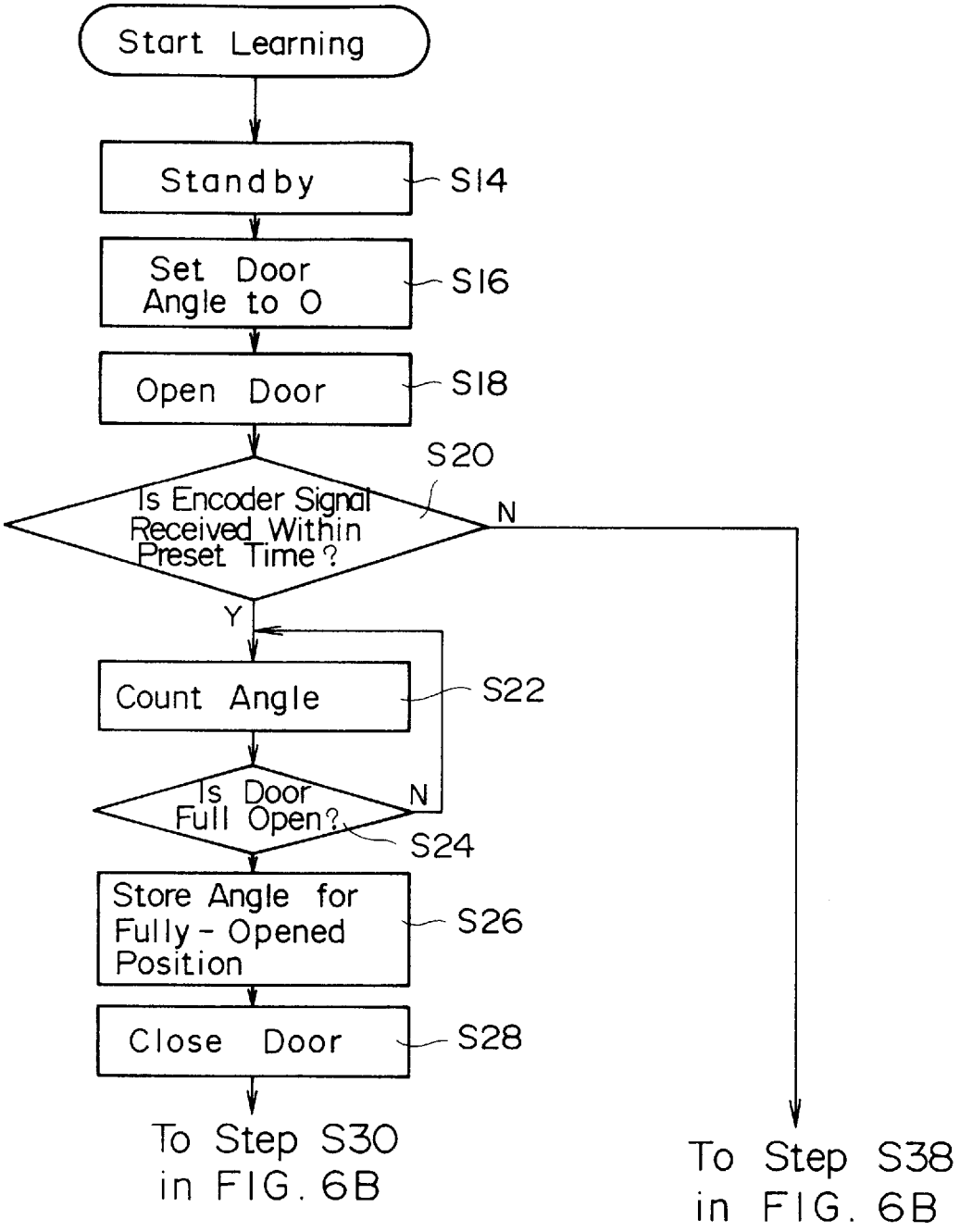
FIGS. 6A and 6B show together a flow chart of the learning operation of the sensors.
Figure 6B:
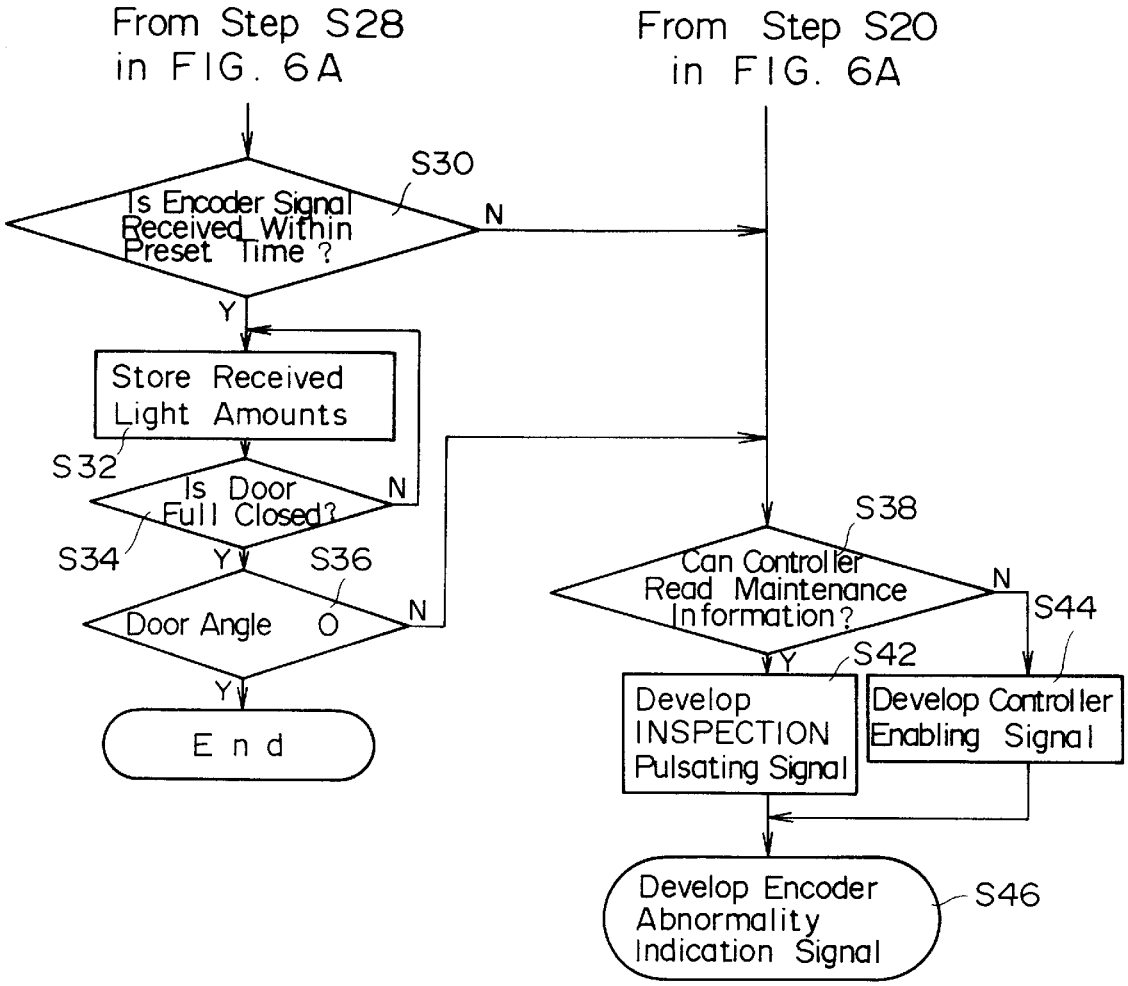

While the learning operation is being performed, the encoder input section 34 and the encoder line are examined by the CPU 24 as to whether they have no failure. As shown in FIGS. 6A and 6B, after power is first supplied to the sensor, the CPU 24 stays in a standby mode for a predetermined time (Step S14). During the standby mode, the door panel 8 is placed in the fully closed position by the door controller 45 or by hand. Thereafter, the CPU 24 sets the door angle (door position) to zero (0) in a door position counter provided by the CPU 24 (Step S16). The CPU 24 closes the relay contact 44*b* so as to make the door controller 45 start the opening operation of the door panel 8 (Step S18).

Next, a judgment is made as to whether the CPU 24 has received an encoder signal from the encoder within a preset time period (Step S20). Specifically, since the door panel 8 is moving, a signal must have been applied from the encoder to the CPU 24 within the preset time period. Accordingly, if no signal from the encoder is applied to the CPU 24 within the preset time period, the CPU 24 judges that the encoder line is broken or the encoder input section 34 fails to work. Actions to be taken when the failure is found will be described later.

In Step S20, if the CPU 24 receives the encoder signal within the preset time period, the CPU 24, upon each reception of the encoder signal, increases the count in the door position counter by a predetermined increment, e.g. one (1), and computes the door position for storage in the data memory 32 (Step S22). Then, the CPU 24 makes a judgment as to whether the encoder signal is still being applied (Step S24). If the encoder signal is still being applied, which means that the door panel 8 has not yet reached the fully opened position, Step S22 is repeated. When no encoder signal is applied to the CPU 24, which means that the door panel 8 has reached the fully opened position, the CPU 24 stores the angle of the door in the fully opened position in the data memory 32 as the full-open angle (Step S26).

Then, the CPU 24 opens the relay contact 44*b*, which makes the door controller 45 close the door panel 8 (Step S28). The CPU 24 makes a judgment as to whether it has received the encoder signal within a preset time period (Step S30). If the encoder signal has not been received within the preset time period, it may be considered that the encoder input section 34 or the encoder line failed when the door panel 8 was being opened. Actions to be taken in such a case will be described later. The receiving of the encoder signal within the preset time period means that neither the encoder input section 34 nor the encoder line has broken during the opening operation of the door panel 8. In this case, the processing advances to the next step.

For the safety sensor, the next step is Step S32. When the encoder signal is applied to the CPU 24, the current door position is computed, and the light-emitters are successively enabled to emit light, and the received-light representative signals from the corresponding light-receivers are stored at memory locations in the data memory 32 as reference values for sub-areas formed by the corresponding light-emitters and light-receivers for the computed current door position. The memory locations are those as defined in the data memory 32 for that current door position in Step S22.

Then, a judgment is made as to whether the encoder signal is still being applied to the CPU 24 , and, if the encoder signal is no longer applied, it is judged that the door panel 8 is at the fully closed position (Step S34). On the other hand, if the encoder signal is still applied to the CPU 24, that is, if the door panel 8 has not yet reached the fully closed position, Steps S32 and S34 are repeated until the door panel 8 reaches the fully closed position.

For the actuator sensor, since it is not necessary to determine reference values for the respective door positions, Step S32 is not executed. Step S34, however, is executed.

Next, whether the door panel angle (position) is at about 0 degrees is judged (Step S36). As described above, the door panel 8 is judged to be in the fully closed position when the encoder signal is no longer applied to the CPU 24. If the encoder input section 34 or the encoder line is broken during the closing operation of the door panel 8, no encoder signal can be applied to the CPU 24, which may make the CPU 24 erroneously judge as if the door panel 8 had reached the fully closed position. In such a case, the door position (which is computed by the CPU 24 on the basis of the encoder signal each time it is applied to the CPU 24) when the CPU 24 makes the erroneous judgment is not zero (0) degrees. If, therefore, the position of the door panel 8 is judged to be substantially different from zero (0) degrees in Step S36, it is judged that the encoder input section 34 or the encoder line has been broken during the closing operation of the door panel 8.

If the CPU 24 determines failure in the encoder input section 34 or in the encoder line in Step S20, S30 or S36, the following actions are taken.

First, the type of the door controller 45 to which the subject sensor is connected is judged (Step S38). The door controller 45 may be of the type which can read maintenance information from a door controller enabling signal applied thereto and indicate that the sensor must be replaced or the sensor must be inspected, or it may be of the type which cannot make such reading. Information about the type of the controller 45 has been set in the sensor beforehand by, for example, setting a DIP switch 33 (FIG. 4) according to the type of the door controller 45. The CPU 24 can know the type of the door controller 45 from it.

Figure 9:
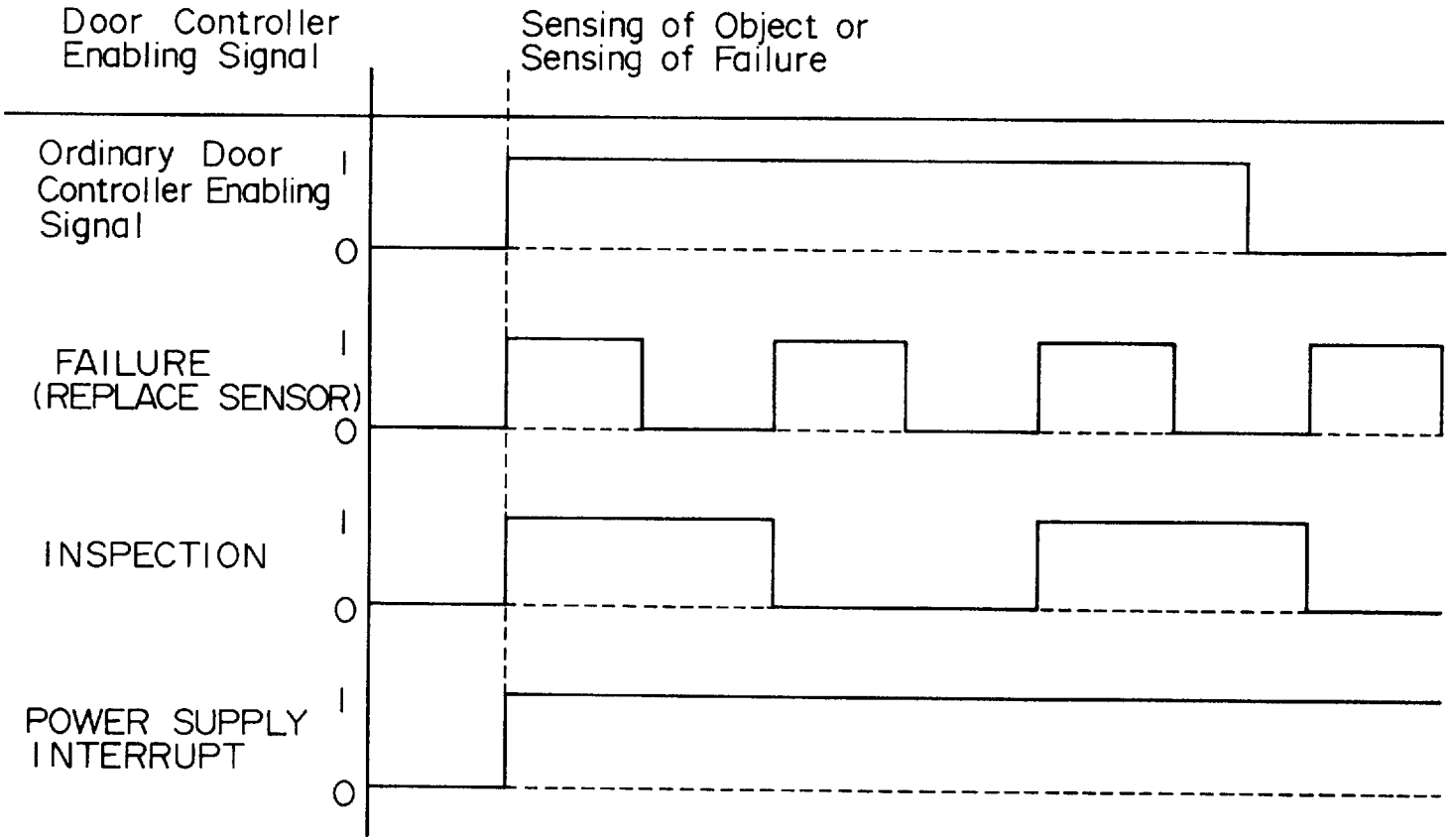
FIG. 9 shows an example of door controller enabling signals to be applied to a door controller by the sensors.

If the door controller 45 is of the type which can judge what actions should be taken against the detected failure, the CPU 24 continuously develops a pulsating door control output signal INSPECTION shown in FIG. 9, so that the relay contact 44*b* is alternately opened and closed repetitively (Step S42). The signal INSPECTION means that the encoder input section 34 and also the encoder line should be inspected.

In contrast, if the door controller 45 is not of the above-described type and, therefore, cannot read the maintenance information, a door controller enabling signal at the H-level, which is also developed when an object is sensed, is continuously developed by the CPU 24. Thus, the relay contact 44*b* is kept open (Step S44).

Once the relay contact 44*b* is switched from its open state to the closed state, the door controller 45 moves the door panel 8 to the fully opened position if the sensor is an actuator sensor. If it is a safety sensor, the door panel 8 is stopped or moved at a low speed, or brought to the fully opened position. Accordingly, although the relay contact 44*b* repetitively alternates between the open state and the closed state, the object can be secured safe.

Following Step S42 or S44, an encoder signal abnormality indication signal is developed (Step S46). This processing will be described later. When this processing is done, neither the light-emitter examination nor the received-light amplifier examination is done any more.

Light-Emitter Examination

Figure 7:
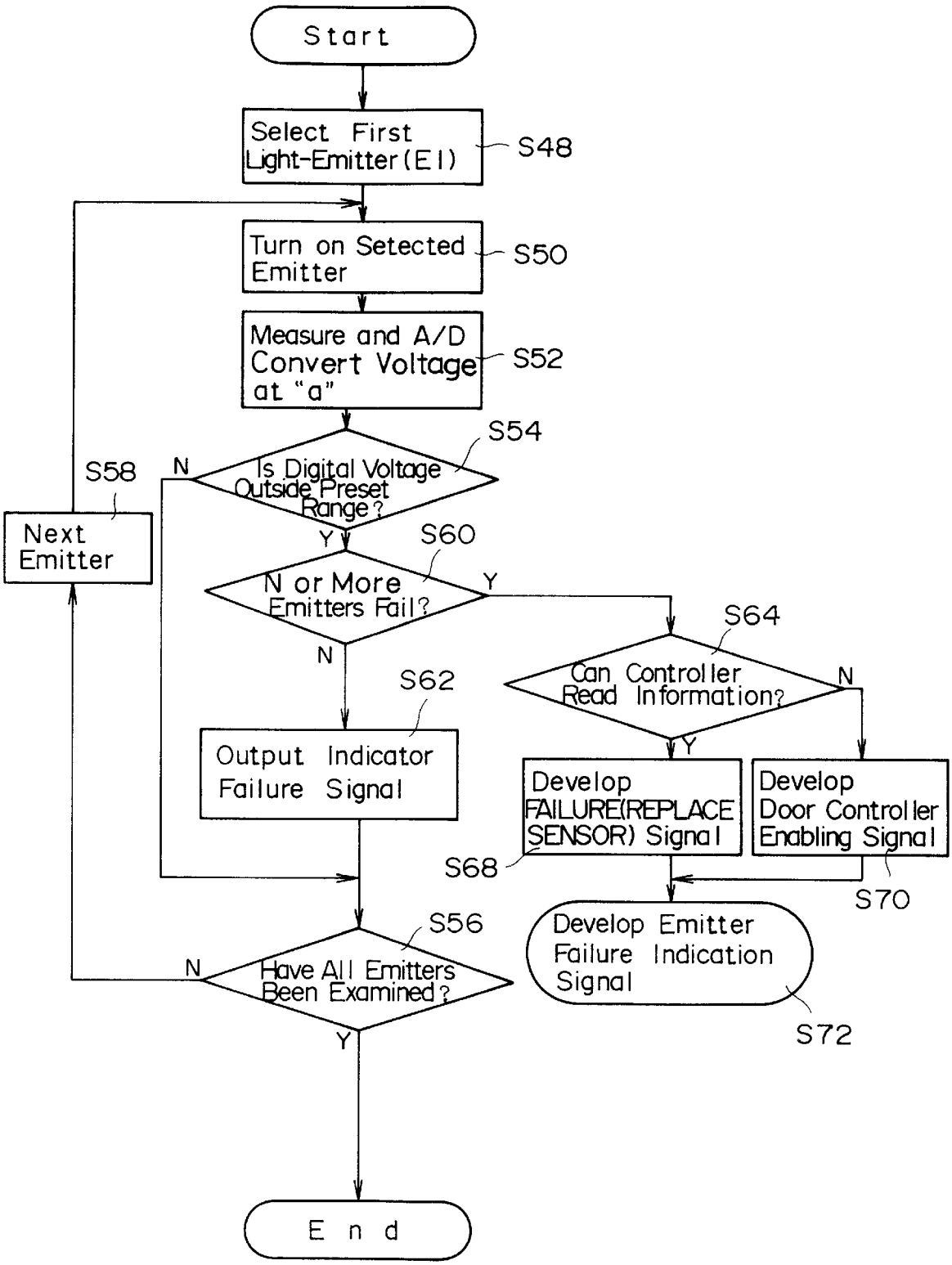
FIG. 7 is a flow chart for detecting failure of the light-emitting unit of the sensors.

Next, the examination of the light emitters done by the CPU 24 is described with reference to FIG. 7.

First, a light-emitter to be enabled first is selected (Step S48). The CPU 24 supplies the driving unit 18 with a control signal which enables the selected light-emitter to emit light (Step S50). The potential at a point "a" in FIG. 4, i.e. the voltage between the anode of the selected light-emitter emitting light and the ground is A/D converted in the A/D converter 30. The resulting digital voltage is applied to the CPU 24 (Step S52).

The CPU 24 makes a judgment as to whether the digital voltage is outside a preset voltage range (Step S54). The preset voltage range is the range of voltages which the point "a" can assume when the light-emitters operate properly. Thus, if the digital voltage is within this voltage range, i.e. if the answer to Step S54 is NO, which means that the selected light-emitter operates properly, the CPU 24 examines whether all of the light-emitters have been examined (Step S56). If not, a next light-emitter is selected (Step S58), and Step S50 is executed for that selected light-emitter.

If the CPU 24 judges that the voltage at the point "a" is outside the preset voltage range, which means that the selected light-emitter fails to operate properly, the count in a counter provided by the CPU 24 for counting the number of light-emitters which do not operate properly, is incremented by one. For the actuator sensors, the CPU 24 judges if the count in the counter is equal to or larger than a predetermined number N (Step S60). If the number of light-emitters which fails is smaller than N, the CPU 24 makes the indicator 46 indicate that indicators fail to properly operate (Step S62), as will be described in detail later, and, then, Step S56 is executed. Thus, in the actuator sensor, if the number of failing light-emitters is less than N, it is indicated by the indicator 46, but the door panel 8 is operated in an ordinary manner. This is because failure of less than N light-emitters does not give substantial influence on the detection of an approaching object, and also because, if the door panel 8 is opened and kept in the fully opened position when, for example, only one light-emitter is broken, the security of the building or room is endangered.

If, on the other hand, the failing light-emitting counter counts N or more, i.e. if N or more light-emitters are judged to be defective, the CPU 24 examines the door controller 45 as to whether it can read the sensor maintenance information from a door controller enabling signal applied thereto (Step S64).

If the door controller 45 is of the type which can read, from a door controller enabling signal, the maintenance information about the manner in which the failure is to be removed, the CPU 24 continuously modifies a door controller enabling signal into a pulsating signal like a signal FAILURE (REPLACE SENSOR) shown in FIG. 9, which makes the relay contact 44*b* alternately opens and closes (Step S68).

If the door controller 45 is of the type which cannot read the sensor maintenance information, the CPU 24 continuously develops an H-level door controller enabling signal which is similar to the one developed when the sensor senses an approaching object. This keeps the relay contact 44*b* open (Step S70).

In case of the safety sensors, Steps S60 and S62 are not executed. If the answer in Step S54 is YES, that is, the selected light-emitter is judged to fail to properly operate, the processing advances directly from Step S54 to Step S64. This is because if only one of the light-emitters of the safety sensor is broken, some action should be taken in order to secure the object's safety.

Following Step S68 or S70, a light-emitter failure indication signal is developed, and failure is indicated on the indicator 46 (Step S72). The failure indication will be described in detail later. In this case, the examination of the received-light amplifier is not done.

Examination of Received-Light Amplifier

Figure 8:
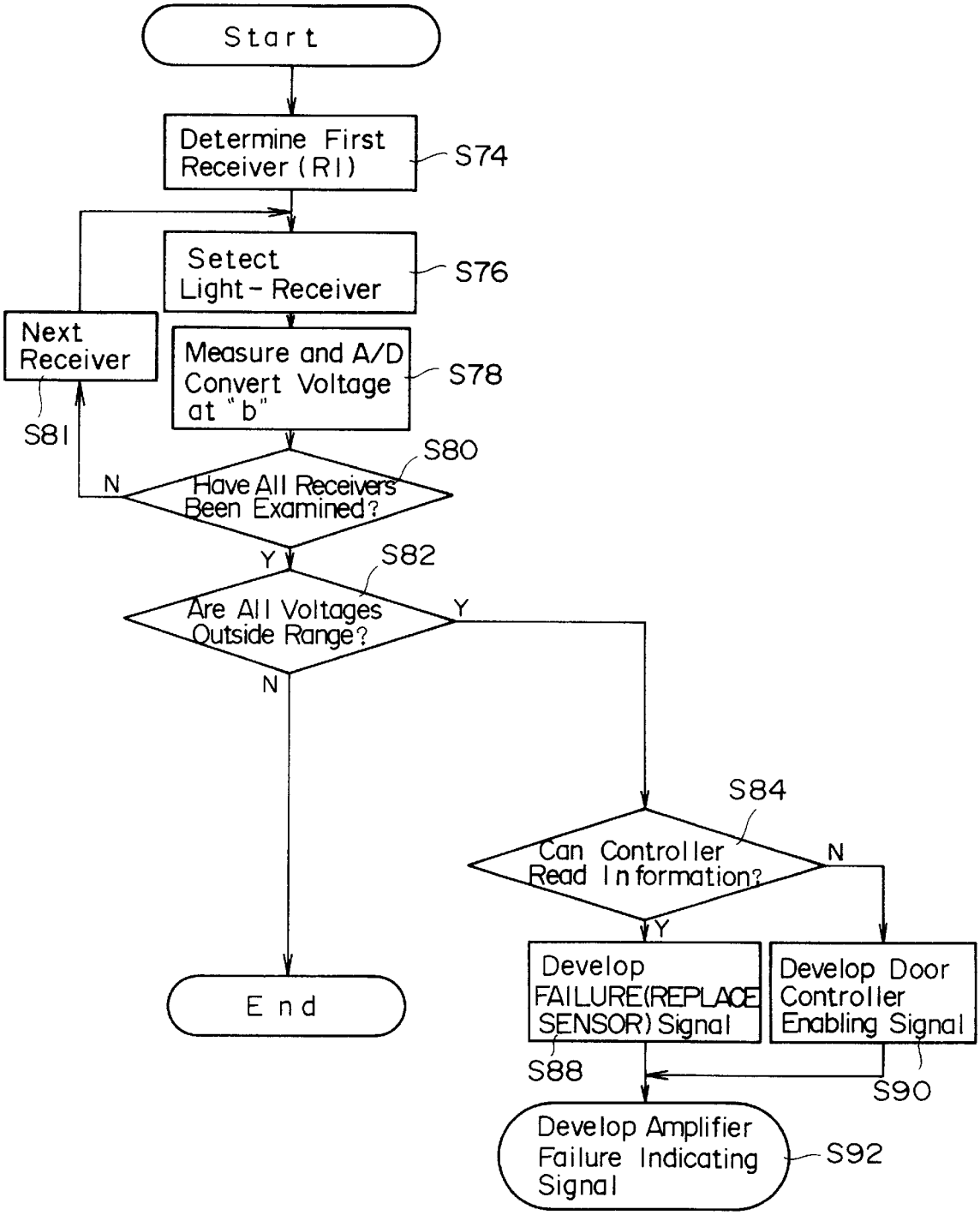
FIG. 8 is a flow chart for detecting failure of the received-light amplifier of the sensors.

Referring to FIG. 8, the examination of the received-light amplifier 28 performed by the CPU 24 is explained.

First, the CPU 24 determines a light-receiver from which a received-light representative signal is first derived (Step S74). The CPU 24 supplies a selection signal to the light-receiver switching circuit 26 so that the received-light representative signal from the selected light-receiver is applied to the received-light amplifier 28 (Step S76). The CPU 24 also controls the driving unit 18 in such a manner that the light-emitter associated with the light-receiver emits light.

The voltage at a point "b" in FIG. 4, i.e. the output voltage of the received-light amplifier 28, is converted into a digital form in the A/D converter 30, and the CPU 24 causes the digital value to be stored in the data memory 32 (Step S78). Then, whether all of the light-receivers have been selected or not is judged (Step S80). If the answer is NO, the next light-receiver is determined (Step S81) and Step S76 is executed. Accordingly, when it is judged in Step S80 that all of the light-receivers have been selected, the data memory 32 has stored therein amplified versions (i.e. measured voltage values) from the received-light amplifier 28 of the received-light representative signals from all of the light-receivers.

If the received-light amplifier 28 is operating properly, the measured voltage values are the amplified versions of the received-light representative signals produced by the light-receivers in response to light which is emitted by the corresponding light-emitters, reflected from an object or the floor, and received by the the light-receivers. Accordingly, if the received-light amplifier 28 operates properly, the measured voltage values must be within a predetermined allowable range. If, on the other hand, the received-light amplifier fails to operate properly, all of the measured voltage values must be outside the range. Thus, the CPU 24 judges whether all of the measured voltage values are outside the predetermined range or not (Step S82). If the answer is YES, it is determined that the received-light amplifier 28 is broken.

The CPU 24 may determine failure of the received-light amplifier 28 when, for example, a measured voltage value based on the received-light representative signal from only one light-receiver is outside the predetermined allowable range. However, the measured voltage value can be outside the allowable voltage range due to influence of, for example, disturbance noise. Accordingly, in the illustrated case, in order to make reliable determination of failure of the received-light amplifier 28, the defectiveness of the received-light amplifier 28 is determined only when all of the measured voltage values are outside the allowable voltage range.

If the received-light amplifier 28 is judged to be defective in Step S82, whether the door controller 45 can read the sensor maintenance information from a door controller enabling signal applied thereto is judged by the CPU 24 (Step S84). If the door controller 45 is of the type which can read the sensor maintenance information from a door controller enabling signal applied thereto, the CPU 24 continuously develops a pulsating door controller enabling signal like the FAILURE (REPLACE SENSOR) signal shown in FIG. 9, so that the relay contact 44*b* alternates opening and closing operations (Step S88).

If the door controller 45 is of the type which cannot read the sensor maintenance information, the CPU 24 continuously develops an H-level door controller enabling signal like the one that is developed when the sensor senses an object, whereby the relay contact 44*b* is kept open (Step S90).

Following Step S88 or S90, a received-light amplifier failure indicating signal is developed (Step S92). The indication will be described later. When Step S92 is executed, Step S10 (FIG. 5) is not executed.

Examination of Control Section

The control section 22 is in the form of one-chip microcomputer which includes the CPU 24, the A/D converter 30 and the data memory 32. A CPU monitoring IC 60 is connected to a voltage source supplying a voltage of +5 V to the control section 22. The CPU monitoring IC 60 monitors the +5 V voltage source as to if it is providing a voltage within a range of voltages required for the proper operation of the control section 22. If the voltage is within the range, the CPU monitoring IC 60 supplies a reset signal at the H level to the CPU 24. If the voltage is outside the range, the CPU monitoring IC 60 periodically changes the level of the reset signal from the H level to the L level for a predetermined short time period at constant intervals of T.

The CPU monitoring IC 60 is supplied with a watchdog signal at predetermined intervals from the CPU 24 when the CPU 24 is operating properly. When the CPU 24 operates improperly for some reasons, no watchdog signal is applied to the CPU monitoring IC 60. In this case, the CPU monitoring IC 60 periodically changes the level of the reset signal applied to the CPU 24 to the L level at the intervals of T as in the case that the voltage from the +5 V voltage source deviates from the required range, until the watchdog signal is applied again to the CPU monitoring IC 60.

This level-changing reset signal is applied to a Y input terminal of the exclusive OR gate 38. Then, regardless of the level of the signal applied to the X input terminal of the exclusive OR gate 38, a pulsating signal is developed at its output terminal Z. This makes the relay contact 44*b* alternately open and close, from which the door controller 45 can know that the CPU 24 is not operating properly or that the voltage supplied to the CPU 24 is not proper.

Since the ratio of the L-level time period to the whole period T of the reset signal is small, the reset signal is applied to a pulse width modifying circuit 40 which extends the L-level time period of the reset signal before applying it to the Y terminal of the exclusive OR gate 38.

Detection of Interruption of Power Supply to Sensor

As described above, when the sensor is sensing no object, current flows in the relay coil 44*a* to thereby open the relay contact 44*b*. Accordingly, if the power supply to the sensor is interrupted, no current flows in the relay coil 44*a* and, therefore, the relay contact 44*b* is kept closed. That is, the relay contact 44*b* is placed in the same state as it is in when the sensor senses an object. Then, the door controller 45 judges as if the sensor had sensed an object. If the sensor is an actuator sensor, the door controller 45 brings the door panel 8 to the fully opened position. If the sensor is an opening path safety sensor, the door controller 45 stops the door panel 8 or moves it at a low speed. If the sensor is a closing path safety sensor, the door controller 45 fully opens the door panel 8. The state or position of the door panel 8 is maintained until the power supply to the sensor is restored, and, therefore, the door panel 8 never moves abruptly.

Signals Supplied from Sensor to Door Controller 45

FIG. 9 shows various types of door controller enabling signals to be supplied to the door controller 45 which can read the information contained in the door controller enabling signal applied to it as to what action should be taken to remove failure of the sensor. More specifically, FIG. 9 shows an ordinary door controller enabling signal supplied to the door controller 45 when the sensor senses an object, a door controller enabling signal, FAILURE (REPLACE SENSOR), which is developed when the sensor must be replaced because N or more light-emitters or the received-light amplifier fails to properly operate, a door controller enabling signal, INSPECTION, developed when the sensor must be inspected because the encoder input section fails to operate properly or the encoder line is broken, and a door controller enabling signal, POWER SUPPLY INTERRUPT, developed when the power supply to the sensor has been interrupted. As is understood from FIG. 9, the signals, except the POWER SUPPLY INTERRUPT door controller enabling signal and the ordinary door controller enabling signal, have different periods. Accordingly, the door controller 45 can judge whether the sensor must be replaced or inspected, from the different periods of the door controller enabling signals.

In place of the above-described types of door controller 45, another type which can identify which portion of the sensor fails may be used. When such a door controller is used, door controller enabling signals as shown in, for example, FIG. 10 may be used. Specifically, when an object is sensed, a constant-level door controller enabling signal is generated. When failure in the light-emitter, failure in the received-light amplifier, abnormality in the encoder signal, and abnormality in the CPU are detected, pulsating door controller enabling signals having different periods are developed. When the power supply to the sensor is interrupted, a constant-level door controller enabling signal is continuously developed. From this information, a maintenance man can know what portion must be repaired or inspected.

Figure 10:
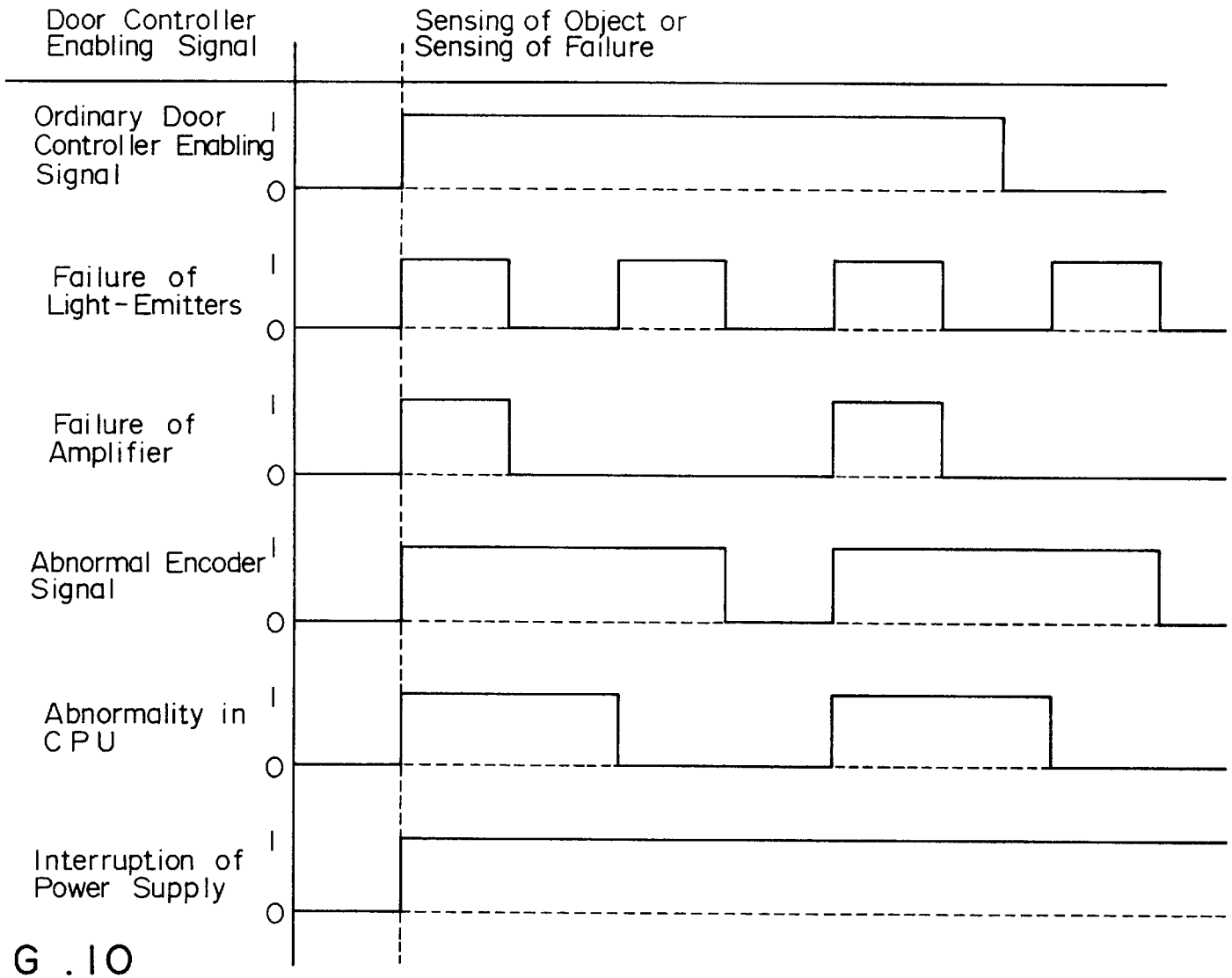
FIG. 10 shows another example of door controller enabling signals to be applied to the door controller by the sensors.

As shown in FIG. 11, the door controller 45 may be arranged to send failure information like the ones shown in FIGS. 9 and 10, via a facsimile modem 62 to, for example, a remote personal computer which may be set in the office of a maintenance man, so that he can obtain information of failure of the sensor before going to inspect the sensor.

A hand-held computer 64 with communication equipment may be connected to the door controller 45. Then, a maintenance man can obtain information about failure from the hand-held computer 64 before he actually starts inspection.

Indication on Indicator 46

Examples of Indications given on the indicator 46 are shown in Table I.

TABLE I

| Failure | Indication |
|---|---|
| Light-Emitters | Intermittent Emission of Red Light |
| Received-Light Amplifier | (Indication of Need for Replacement of Sensor) |
| Encoder Signal | Intermittent Emission of Green Light (Indication of Need for Inspection) |
| CPU | (Unknown) |
| Power Supply | (No Indication) |

As shown in Table I, when the light-emitter or the received-light amplifier is not operating properly, the CPU 24 makes the red-light emitting diode 48R intermittently emit light, which indicates that the sensor must be replaced. When the encoder input section 34 does not work properly or when the encoder line is broken, the CPU 24 makes the green-light emitting diode 48G intermittently emit light. From this indication, a maintenance man can know that the encoder input section or the encoder line must be inspected. The indication which is provided when the CPU 24 operates abnormally or when the supply voltage for the sensor becomes abnormal is not known. When the power supply to the sensor is interrupted, no indication is given.

If the door controller 45 is of the type which cannot read such maintenance information, one can know, from these indications, what step should be taken to remove the failure. In case of interruption of power supply to the sensor, it is not indicated on the indicator, but it is known because the door panel is kept open or stopped, or the moving speed of the door panel is lowered.

In case of an actuator sensor, the red-light emitting diode is alternately turned on and off, even when the number of failing light-emitters is less than N. In this case, however, the door panel operates in the normal manner. On the other hand, if N or more light-emitters are broken, the door panel is kept open and, in addition, the red-light emitting diode 46R is alternately turned on and off. Therefore, one can know that N or more light-emitters are broken when the door panel is kept open, with the red-light emitting diode 46R intermittently emitting red light.

As shown in the following Table II, different indications may be provided for indicating failure in different portions.

TABLE II

| Failure | Indication |
|---|---|
| Light-Emitters | Intermittent Emission of Red Light (Indication of Failure of Light-Emitters) |
| Received-Light Amplifier | Intermittent Emission of Orange Light (Indication of Failure of Amplifier) |
| Encoder Signal | Intermittent Emission of Green Light (Indication of Abnormal Encoder Signal) |
| CPU | (Unknown) |
| Power Supply | (No Indication) |

Intermittent emission of orange light is provided when the encoder input section or the encoder line is broken, and it can be produced by alternation of the simultaneous energizing and de-energizing of the red-light emitting diode 46R and the green-light emitting diode 46G.

Second Embodiment

Figure 12:
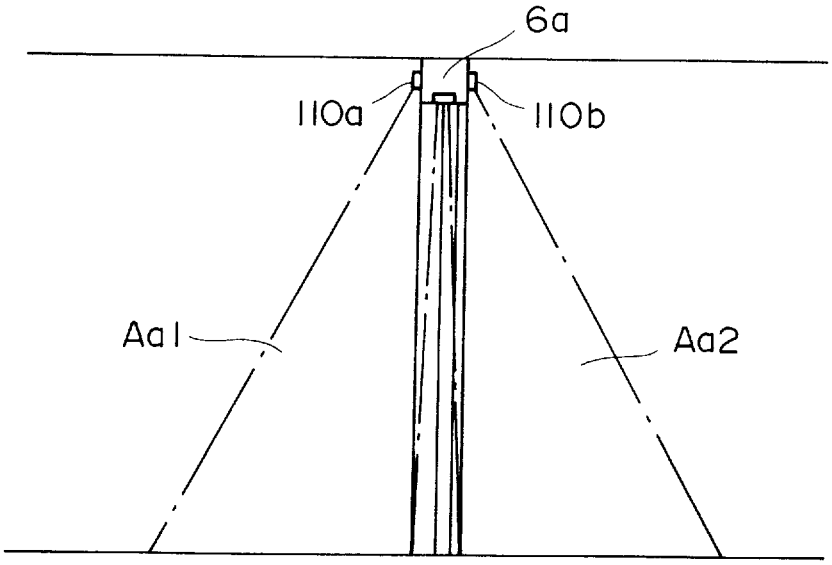
FIG. 12 is a side view of a sliding door system employing sensors of the present invention.
Figure 13A:
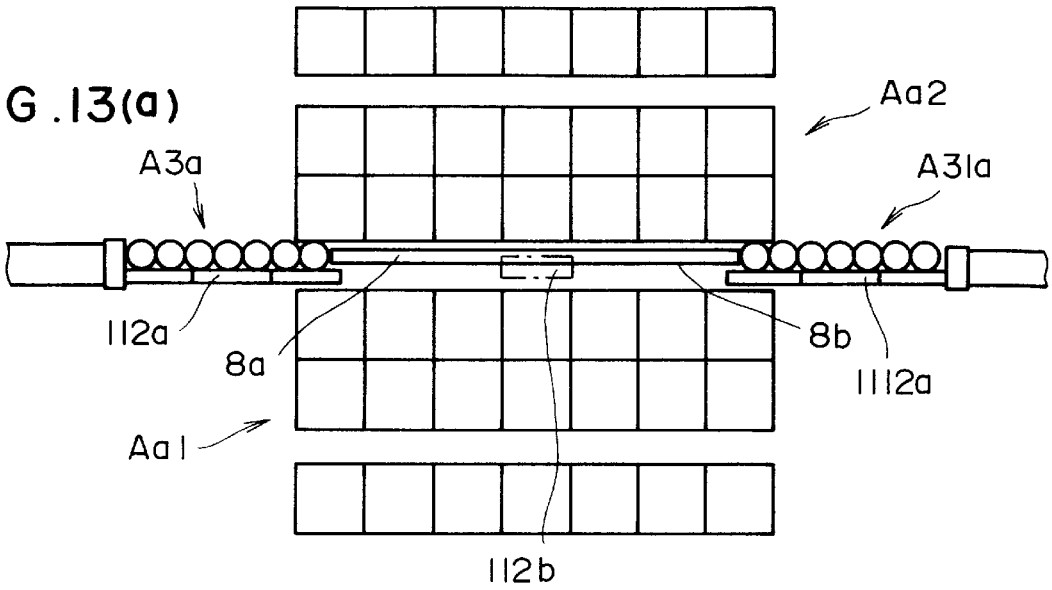
FIG. 13(*a*) shows sensing areas of actuator sensors and sensing areas of safety sensors for the closing path of the door panels of the sliding door system of FIG. 12, and FIG. 13(*b*) shows sensing areas of safety sensors for the opening path of the door panels of the sliding door system of FIG. 12.
Figure 13B:
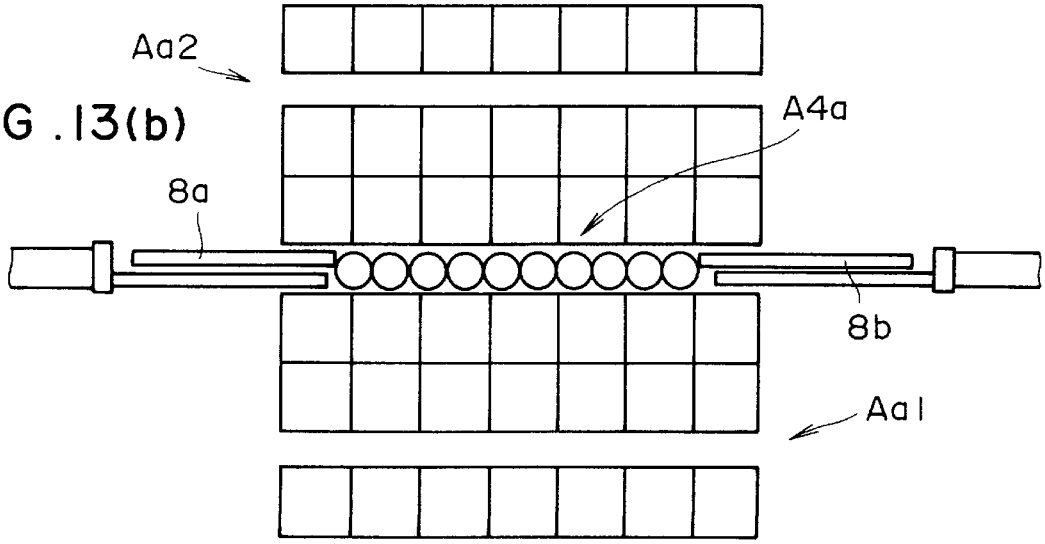

The present invention can be also embodied in sensors for a sliding door system as shown in FIGS. 12 and 13. The sliding door system shown in FIGS. 12 and 13 includes actuator sensors 110*a* and 110*b*, and safety sensors 112*a*, 1112*a* and 112*b*. The sliding door system of this second embodiment includes two door panels 8*a* and 8*b*, as shown in FIG. 13(*a*).

On opposite sides of a lintel 6*a*, the actuator sensors 110*a* and 110*b* are mounted. The actuator sensors 110*a* and 110*b* provide a sensing area Aa1 and a sensing area Aa2, respectively, on the opposite sides of the door panels. As shown in FIG. 13(*a*), each of the sensing areas Aa1 and Aa2 are formed of a plurality of sub-areas. Each of the actuator sensors 110*a* and 110*b* includes a light-emitting unit including a plurality of light-emitters and a light-receiving unit including a plurality of light-receivers, so that they can provide a plurality of sub-areas.

The safety sensors 112*a* and 1112*a* are disposed above opening paths along which the door panels 8*a* and 8*b* move from their fully closed positions to the fully opened positions. The safety sensors 112*a* and 1112*a* cover the opening paths and areas near the opening paths, and, for that purpose, they include a light-emitting unit including a plurality of light-emitters and a light-receiving unit including a plurality of light-receivers, which together form sensing areas A3*a* and A31*a*. The sensing areas A3*a* and A31*a* include a plurality of sub-areas covering the opening paths and their neighborhoods.

The safety sensor 112*b* is located above the door panels 8*a* and 8*b* in their fully closed positions, as shown in FIG. 13(*a*). The sensor 112*b* includes a light-emitting unit having a plurality of light-emitters and a light-receiving unit having a plurality of light-receivers, which together form a sensing area A4*a* including a plurality of sub-areas which cover closing paths along which the door panels 8*a* and 8*b* move to the fully closed positions and their neighborhoods, as shown in FIG. 13(*b*).

When an object is sensed by the actuator sensor 110*a* or 110*b*, the door panels 8*a* and 8*b* are opened. If the safety sensor 112*a* or 1112*a* senses an object when the door panels 8*a* and 8*b* are moving to the fully opened positions, the door panels 8*a* and 8*b* are stopped or moved at a reduced speed. In order to prevent the door panels 8*a* and 8*b* from being sensed by the safety sensors 112*a* and 1112*a* as objects, the sub-areas are successively disabled from the ones closest to the respective door panels 8*a* and 8*b* toward the remotest ones as the door panels 8*a* and 8*b* approach the fully opened positions.

When an object is sensed by the safety sensor 112*b* while the door panels 8*a* and 8*b* are closing, the door panels 8*a* and 8*b* reverse their moving directions to the fully opened positions. In this case, in order to prevent the door panels 8*a* and 8*b* from being sensed by the safety sensor 112*b* when the door panels 8*a* and 8*b* moving back toward the fully opened position, the sub-areas are successively disabled from the ones closest to the respective door panels 8*a* and 8*b* toward the remotest ones as the door panels.

The structures and operations of the sensors are the same as the sensors of the first embodiment and, therefore, no more detailed descriptions about them are given. It should be noted, however, that in the safety sensors 112*a*, 1112*a* and 112*b*, the door positions are computed from signals provided by the encoder and they are used in disabling the above-described sub-areas of the sensing areas.

Modification of Embodiments

Various modifications are possible to the sensors according to the above-described two embodiments. For example, each of the sensors according to the first and second embodiments includes light-emitters emitting light to a floor and light-receivers receiving light reflected from the floor, but it may include light-emitters emitting light into the space near the door panel(s) and light-receivers receiving light reflected from the space.

In the above-described embodiments, a door controller enabling signal is applied to the door controller via the relay contact 44*b*, but it may be sent to the door controller in a serial form, using a communications interface, e.g. RS232C.

What is claimed is:

1. A door sensor with a self-diagnosing function, for sensing an object approaching a door panel and actuating the door panel in response to the sensing of the object, comprising:

a light-emitting unit emitting light into a space or onto a floor near said door panel;

a light-receiving unit receiving light emitted by said light-emitting unit and reflected from an object in said space or on said floor or from said floor; and a control unit determining the presence of an object on the basis of the amount of light received by said light-receiving unit, said control unit being adapted to supply, to a door controller which controls the opening and closing of said door panel, a door controller enabling signal for opening said door panel when the presence of an object is determined;

wherein said control unit includes a plurality of failure detecting means for detecting failure in portions of said light-emitting unit, light-receiving unit and control unit, and develops continuously said door controller enabling signal when one of said failure detecting means detects failure in any of said portions.

2. The door sensor according to claim 1 wherein:

said control unit includes a control section;

one of said failure detecting means is a light-emitting unit failure detecting program for detecting failure of said light-emitting unit, said program being stored in said control section; and said light-emitting unit failure detecting program determines failure of said light-emitting unit when a value of a voltage for driving said light-emitting unit is outside an allowable voltage range.

3. The door sensor according to claim 1 wherein:

said light-emitting unit includes a plurality of light-emitters;

said control unit includes a control section;

one of said failure detecting means is a light-emitting unit failure detecting program for detecting failure of said light-emitting unit, said program being stored in said control section; and said light-emitting unit failure detecting program determines failure of said light-emitting unit when values of voltages for driving a predetermined number of light-emitters are outside an allowable voltage range.

4. The door sensor according to claim 1 wherein:

said light-receiving unit includes a light-receiver and a received-light amplifier for amplifying a signal representative of the amount of light received by said light-receiver;

said control unit includes a control section;

one of said failure detecting means is a received-light amplifier failure detecting program for detecting failure of said received-light amplifier, said program being stored in said control section; and said received-light amplifier failure detecting program determines failure of said received-light amplifier when a value of an output voltage of said received-light amplifier is outside an allowable voltage range.

5. The door sensor according to claim 1 wherein:

said light-receiving unit includes a plurality of light-receivers and a received-light amplifier for amplifying successively signals representative of the amounts of light received by said respective light-receivers;

said control unit includes a control section;

one of said failure detecting means is a received-light amplifier failure detecting program for detecting failure of said received-light amplifier, said program being stored in said control section; and said received-light amplifier failure detecting program determines failure of said received-light amplifier when values of all of output voltages from said received-light amplifier corresponding to signals representative of the amounts of light received by said respective light-receivers are outside an allowable voltage range.

6. The door sensor according to claim 1 wherein:

one of said failure detecting means is a monitoring section for monitoring said control unit and a power supply to said control section as to whether said control section and power supply operate normally;

said monitoring section determines that said control section is operating abnormally when a watchdog signal is not developed periodically by said control section and that the power supply to said control section fails when a voltage supplied to said control section decreases below a predetermined value.

7. The door sensor according to claim 1 wherein:

one of said failure detecting means is a relay circuit activated when power supply to said door sensor is interrupted, said relay circuit having a contact adapted to couple a continuous door controller enabling signal to said door controller when power supply to said door sensor is interrupted.

8. A door sensor with a self-diagnosing function, for sensing an object in opening and closing paths of a door panel for securing the object against colliding with or being caught in the door panel, comprising:

a light-emitting unit emitting light to the closing path or a vicinity thereof along which said door panel moves from a fully opened position thereof to a fully closed position;

a light-receiving unit receiving light emitted by said light-emitting unit and reflected from an object in said closing path or the vicinity thereof or from said closing path or the vicinity thereof; and a control unit determining the presence of an object on the basis of the amount of light received by said light-receiving unit, said control unit being adapted to supply, to a door controller which controls the opening and closing of said door panel, a door controller enabling signal for opening said door panel when the presence of an object is determined;

wherein said control unit includes a plurality of failure detecting means for detecting failure in portions of said light-emitting unit, light-receiving unit and control unit, and develops continuously said door controller enabling signal when one of said failure detecting means detects failure in any of said portions.

9. The door sensor according to claim 8 wherein:

said control unit receives a signal representative of the current position of said door panel from an encoder;

said control unit includes a control section;

one of said failure detecting means is an encoder failure detecting program stored in said control section; and said encoder failure detecting program determines that an encoder input section of said control unit receiving said door position representative signal from said encoder fails or an encoder line extending between said encoder and said control unit is broken when said door position representative signal from said encoder is not applied to said control unit within a predetermined time period after said door panel starts moving.

10. The door sensor according to claim 8 wherein:

said control unit receives a signal representative of the current position of said door panel from an encoder;

said control unit includes a control section;

one of said failure detecting means is an encoder failure detecting program stored in said control section; and said encoder failure detecting program determines that an encoder input section of said control unit receiving said door position representative signal from said encoder fails or an encoder line extending between said encoder and said control unit is broken when the door position representative signal developed at a door position said door panel currently assumes is not equal to the door position representative signal developed by said encoder at said door position which said door panel assumed one cycle of movement before said door panel has moved to reach said current door position.

11. The door sensor according to claim 8 wherein:

said control unit includes a control section;

one of said failure detecting means is a light-emitting unit failure detecting program for detecting failure of said light-emitting unit, said program being stored in said control section; and said light-emitting unit failure detecting program determines failure of said light-emitting unit when a value of a voltage for driving said light-emitting unit is outside an allowable voltage range.

12. The door sensor according to claim 8 wherein:

said light-receiving unit includes a light-receiver and a received-light amplifier for amplifying a signal representative of the amount of light received by said light-receiver;

said control unit includes a control section;

one of said failure detecting means is a received-light amplifier failure detecting program for detecting failure of said received-light amplifier, said program being stored in said control section; and said received-light amplifier failure detecting program determines failure of said received-light amplifier when a value of an output voltage of said received light amplifier is outside an allowable voltage range.

13. The door sensor according to claim 8, wherein:

said light receiving unit includes a plurality of light-receivers and a received-light amplifier for amplifying successively signals representative of the amount of light received by said respective light receivers;

said control unit includes a control section;

one of said failure detecting means is a received-light amplifier failure detecting program for detecting failure of said received-light amplifier, said program being stored in said control section; and said received-light amplifier failure detecting program determines failure of said received-light amplifier when values of all of output voltages from said received-light amplifier corresponding to signals representative of the amounts of light received by said respective light-receivers are outside an allowable voltage range.

14. The door sensor according to claim 8 wherein:

one of said failure detecting means is a monitoring section for monitoring said control unit and a power supply to said control section as to whether said control section and power supply operate normally;

said monitoring section determines that said control section is operating abnormally when a watchdog signal is not developed periodically by said control section and that the power supply to said control section fails when a voltage supplied to said control section decreases below a predetermined value.

15. The door sensor according to claim 8 wherein:

one of said failure detecting means is a relay circuit activated when power supply to said door sensor is interrupted, said relay circuit having a contact adapted to couple a continuous door controller enabling signal to said door controller when power supply to said door sensor is interrupted.

16. A door sensor with a self-diagnosing function, for sensing an object in opening and closing paths of a door panel for securing the object against colliding with or being caught in the door panel, comprising:

a light-emitting unit emitting light to the opening path or a vicinity thereof along which said door panel moves from a fully closed position thereof to a fully opened position;

a light-receiving unit receiving light emitted by said light-emitting unit and reflected from an object in said opening path or the vicinity thereof or from said opening path or the vicinity thereof; and a control unit determining the presence of an object on the basis of the amount of light received by said light-receiving unit, said control unit being adapted to supply, to a door controller which control the opening and closing of said door panel, a door controller enabling signal for stopping said door panel or opening said door panel at a low speed when the presence of an object is determined;

wherein said control unit includes a plurality of failure detecting means for detecting failure in portions of said light-emitting unit, light-receiving unit and control unit, and develops continuously said door controller enabling signal when one of said failure detecting means detects failure in any of said portions.

17. The door sensor according to claim 16 wherein:

said control unit includes a control section;

one of said failure detecting means is a light-emitting unit failure detecting program for detecting failure of said light-emitting unit, said program being stored in said control section; and said light-emitting unit failure detecting program determines failure of said light-emitting unit when a value of a voltage for driving said light-emitting unit is outside an allowable voltage range.

18. The door sensor according to claim 16 wherein:

said light-receiving unit includes a light-receiver and a received-light amplifier for amplifying a signal representative of the amount of light received by said light-receiver;

said control unit includes a control section;

one of said failure detecting means is a received-light amplifier failure detecting program for detecting failure of said received-light amplifier, said program being stored in said control section; and said received-light amplifier failure detecting program determines failure of said received-light amplifier when a value of an output voltage of said received light amplifier is outside an allowable voltage range.

19. The door sensor according to claim 16, wherein:

said light-receiving unit includes a plurality of light-receivers and a received-light amplifier for amplifying successively signals representative of the amount of light received by said respective light-receivers;

said control unit includes a control section;

one of said failure detecting means is a received-light amplifier failure detecting program for detecting failure of said received-light amplifier, said program being stored in said control section; and said received-light amplifier failure detecting program determines failure of said received-light amplifier when values of all of output voltages from said received-light amplifier corresponding to signals representative of the amounts of light received by said respective light-receivers are outside an allowable voltage range.

20. The door sensor according to claim 16 wherein:

said control unit receives a signal representative of the current position of said door panel from an encoder;

said control unit includes a control section;

one of said failure detecting means is an encoder failure detecting program stored in said control section; and said encoder failure detecting program determines that an encoder input section of said control unit receiving said door position representative signal from said encoder fails or an encoder line extending between said encoder and said control unit is broken when said door position representative signal from said encoder is not applied to said control unit within a predetermined time period after said door panel starts moving.

21. The door sensor according to claim 16 wherein:

said control unit receives a signal representative of the current position of said door panel from an encoder;

said control unit includes a control section;

one of said failure detecting means is an encoder failure detecting program stored in said control section; and said encoder failure detecting program determines that an encoder input section of said control unit receiving said door position representative signal from said encoder fails or an encoder line extending between said encoder and said control unit is broken when the door position representative signal developed at a door position representative signal developed by said encoder at said door position which said door panel assumed one cycle of movement before said door panel has moved to reach said current door position.

22. The door sensor according to claim 16 wherein:

one of said failure detecting means is a monitoring section for monitoring said control unit and a power supply to said control section as to whether said control section and power supply operate normally;

said monitoring section determines that said control section is operating abnormally when a watchdog signal is not developed periodically by said control section and that the power supply to said control section fails when a voltage supplied to said control section decreases below a predetermined value.

23. The door sensor according to claim 16 wherein:

one of said failure detecting means is a relay circuit activated when power supply to said door sensor is interrupted, said relay circuit having a contact adapted to couple a continuous door controller enabling signal to said door controller when power supply to said door sensor is interrupted.

24. A door sensor with a self-diagnosing function comprising:

a light-emitting unit emitting light into a space or onto a floor near a door panel;

a light-receiving unit receiving light emitted by said light-emitting unit and reflected from an object in said space or on said floor or from said floor; and a control unit determining the presence of an object approaching said door panel on the basis of the amount of light received by said light-receiving unit, said control unit being adapted to supply, to a door controller which controls the opening and closing of said door panel, a door controller enabling signal when the presence of an object is determined;

wherein said control unit includes a plurality of failure detecting means for detecting failure in portions of said light-emitting unit, light-receiving unit and control unit; and when one of said failure detecting means detects failure in any of said portions, said control unit develops continuously said door controller enabling signal including information relating to the detected failure.

25. The door sensor according to claim 24 wherein:

said control unit includes a signal output section for supplying a door controller enabling signal to said door controller; and when one of said failure detecting means detects failure in any of said portions of said light-emitting unit, light-receiving unit and control unit, said control unit continuously develops a pulsating door controller enabling signal indicating the portion including the detected failure at said signal output section.

26. The door sensor according to claim 24 wherein:

said control unit includes a signal output section for supplying a door controller enabling signal to said door controller; and when one of said failure detecting means detects failure in any of said portions of said light-emitting unit, light-receiving unit and control unit, said control unit continuously develops, at said signal output section, a pulsating door controller enabling signal indicating which step should be taken, replacement or inspection of said door sensor.

27. A door sensor with a self-diagnosing function comprising:

a light-emitting unit emitting light into a space or onto a floor near a door panel;

a light-receiving unit receiving light emitted by said light-emitting unit and reflected from an object in said space or on said floor or from said floor;

a control unit determining the presence of an object approaching said door panel on the basis of the amount of light received by said light-receiving unit, said control unit being adapted to supply, to a door controller which controls the opening and closing of said door panel, a door controller enabling signal when the presence of an object is determined; and an indicator section for indicating an operating state of said door sensor;

wherein said control unit includes a plurality of failure detecting means for detecting failure in portions of said light-emitting unit, light-receiving unit and control unit; and when one of said failure detecting means detects failure in any of said portions, said control unit develops continuously said door controller enabling signal and also makes said indicator section indicate information relating to the detected failure.

28. The door sensor according to claim 27 wherein:

said control unit makes said indicator section provide indication showing the portion having the detected failure.

29. The door sensor according to claim 27 wherein:

said control unit makes said indicator section provide indication as to which action should be taken, replacement or inspection of said door sensor.

* * * * *